US006476824B1

(12) United States Patent
Suzuki et al.

(10) Patent No.: US 6,476,824 B1
(45) Date of Patent: Nov. 5, 2002

(54) LUMINANCE RESOLUTION ENHANCEMENT CIRCUIT AND DISPLAY APPARATUS USING SAME

(75) Inventors: Yoshito Suzuki, Tokyo (JP); Kouji Minami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/354,442

(22) Filed: Jul. 16, 1999

(30) Foreign Application Priority Data

Aug. 5, 1998 (JP) ..... 10-221999

(51) Int. Cl.[7] ..... G09G 5/10
(52) U.S. Cl. ..... 345/690; 345/694
(58) Field of Search ..... 345/136, 138, 345/147, 690, 691, 694, 696; 382/300; 348/771, 565

(56) References Cited

U.S. PATENT DOCUMENTS 3,961,134 A * 6/1976 Jarvis ..... 315/169.4
4,827,343 A * 5/1989 Naimpally ..... 348/565
5,673,065 A * 9/1997 DeLeeuw ..... 345/593
5,712,657 A * 1/1998 Eglit et al. ..... 345/147
5,726,718 A 3/1998 Doherty et al.
5,777,599 A * 7/1998 Poduska ..... 345/136
5,917,963 A * 6/1999 Miyake ..... 382/300
6,008,794 A * 12/1999 Ishii ..... 345/694
6,069,609 A * 5/2000 Katsuhiro et al. ..... 345/147
6,108,122 A * 8/2000 Ulrich et al. ..... 345/147

FOREIGN PATENT DOCUMENTS

JP A6 295161 10/1994
JP A8 149398 6/1996

* cited by examiner

*Primary Examiner*—Jeffery Brier
(74) *Attorney, Agent, or Firm*—Birch, Stewart, Kolasch & Birch, LLP

(57) ABSTRACT

A luminance resolution enhancement circuit receives an (m+n) -bit image signal having an m-bit displayable component and an n-bit non-displayable component. An address generating element generates relative spatial and temporal coordinates of the pixel values in the image signal. For each pixel value, an average element calculates the average non-displayable component of the image signal in an averaging region including the pixel value, and a dithering element generates a dither signal responsive to the relative spatial and temporal coordinates of the pixel and the calculated average value. A processor additively combines the dither signal with the displayable component of the image signal, thereby generating an m-bit output image signal having a simulated luminance resolution exceeding m bits.

31 Claims, 25 Drawing Sheets

FIG.7

C

| | | |
|---|---|---|
| 0 | 0 | 1 |
| 2 | 3 | 0 |
| 1 | 0 | 0 |

FIG.8

| | f | 0 | | 1 | |
|---|---|---|---|---|---|
| a | v \ h | 0 | 1 | 0 | 1 |
| 0 | 0 | 0 | 0 | 0 | 0 |
| | 1 | 0 | 0 | 0 | 0 |
| 1 | 0 | 1 | 0 | 0 | 0 |
| | 1 | 0 | 0 | 0 | 1 |
| 2 | 0 | 1 | 0 | 0 | 1 |
| | 1 | 0 | 1 | 1 | 0 |
| 3 | 0 | 1 | 1 | 1 | 0 |
| | 1 | 0 | 1 | 1 | 1 |

FIG.9

ROW 1
COLUMN 1

ROW 1
COLUMN 2

| | | | | | | | | | |
|---|---|---|---|---|---|---|---|---|---|
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |
| 0 | 0 | 0 | 1 | 1 | 2 | 2 | 3 | 3 | 3 |

FIG.10

ROW 1
COLUMN 2

| | | | | | | | |
|---|---|---|---|---|---|---|---|
| 0.0 | 0.0 | 0.5 | 1.0 | 1.5 | 2.0 | 2.5 | 3.0 |
| 0.0 | 0.0 | 0.5 | 1.0 | 1.5 | 2.0 | 2.5 | 3.0 |
| 0.0 | 0.0 | 0.5 | 1.0 | 1.5 | 2.0 | 2.5 | 3.0 |
| 0.0 | 0.0 | 0.5 | 1.0 | 1.5 | 2.0 | 2.5 | 3.0 |
| 0.0 | 0.0 | 0.5 | 1.0 | 1.5 | 2.0 | 2.5 | 3.0 |
| 0.0 | 0.0 | 0.5 | 1.0 | 1.5 | 2.0 | 2.5 | 3.0 |

FIG.11

| | | | | | | | |
|---|---|---|---|---|---|---|---|
| 0 | 0 | 1 | 1 | 2 | 2 | 3 | 3 |
| 0 | 0 | 1 | 1 | 2 | 2 | 3 | 3 |
| 0 | 0 | 1 | 1 | 2 | 2 | 3 | 3 |
| 0 | 0 | 1 | 1 | 2 | 2 | 3 | 3 |
| 0 | 0 | 1 | 1 | 2 | 2 | 3 | 3 |
| 0 | 0 | 1 | 1 | 2 | 2 | 3 | 3 |

FIG.12A f=0

| | | | | | | | |
|---|---|---|---|---|---|---|---|
| 0 | 0 | 4 | 0 | 4 | 0 | 4 | 4 |
| 0 | 0 | 0 | 0 | 0 | 4 | 0 | 4 |
| 0 | 0 | 4 | 0 | 4 | 0 | 4 | 4 |
| 0 | 0 | 0 | 0 | 0 | 4 | 0 | 4 |
| 0 | 0 | 4 | 0 | 4 | 0 | 4 | 4 |
| 0 | 0 | 0 | 0 | 0 | 4 | 0 | 4 |

FIG.12B f=1

| | | | | | | | |
|---|---|---|---|---|---|---|---|
| 0 | 0 | 0 | 0 | 0 | 4 | 4 | 0 |
| 0 | 0 | 0 | 4 | 4 | 0 | 4 | 4 |
| 0 | 0 | 0 | 0 | 0 | 4 | 4 | 0 |
| 0 | 0 | 0 | 4 | 4 | 0 | 4 | 4 |
| 0 | 0 | 0 | 0 | 0 | 4 | 4 | 0 |
| 0 | 0 | 0 | 4 | 4 | 0 | 4 | 4 |

FIG.13

| | | | | | | | |
|---|---|---|---|---|---|---|---|
| 0 | 0 | 2 | 0 | 2 | 2 | 4 | 2 |
| 0 | 0 | 0 | 2 | 2 | 2 | 2 | 4 |
| 0 | 0 | 2 | 0 | 2 | 2 | 4 | 2 |
| 0 | 0 | 0 | 2 | 2 | 2 | 2 | 4 |
| 0 | 0 | 2 | 0 | 2 | 2 | 4 | 2 |
| 0 | 0 | 0 | 2 | 2 | 2 | 2 | 4 |

| f | 0 | | 1 | |
|---|---|---|---|---|
| v \ h | 0 | 1 | 0 | 1 |
| 0 | 3 | 1 | 0 | 2 |
| 1 | 0 | 2 | 3 | 1 |

FIG.22

| | | | | | | | | | | | | | | | | | | | | | | | |
|---|---|---|---|---|---|---|---|---|---|---|---|---|---|---|---|---|---|---|---|---|---|---|---|
| | | f | 0 | | | | 1 | | | | 2 | | | | 3 | | | | | | | | |
| | a | h / v | 0 | 1 | 2 | 3 | 0 | 1 | 2 | 3 | 0 | 1 | 2 | 3 | 0 | 1 | 2 | 3 |
| 1 | | 0 | 1 | 0 | 0 | 0 | 0 | 0 | 0 | 0 | 0 | 0 | 1 | 0 | 0 | 0 | 0 | 0 |
| | | 1 | 0 | 0 | 0 | 0 | 0 | 0 | 0 | 0 | 0 | 0 | 0 | 0 | 0 | 0 | 0 | 0 |
| | | 2 | 0 | 0 | 1 | 0 | 0 | 0 | 0 | 0 | 1 | 0 | 0 | 0 | 0 | 0 | 0 | 0 |
| | | 3 | 0 | 0 | 0 | 0 | 0 | 0 | 0 | 0 | 0 | 0 | 0 | 0 | 0 | 0 | 0 | 0 |

FIG.23

| | | f | 0 | | | | 1 | | | | 2 | | | | 3 | | | |
|---|---|---|---|---|---|---|---|---|---|---|---|---|---|---|---|---|---|---|
| | a | h / v | 0 | 1 | 2 | 3 | 0 | 1 | 2 | 3 | 0 | 1 | 2 | 3 | 0 | 1 | 2 | 3 |
| 1 | | 0 | 1 | 0 | 0 | 0 | 0 | 0 | 0 | 0 | 0 | 0 | 0 | 0 | 0 | 0 | 1 | 0 |
| | | 1 | 0 | 0 | 0 | 0 | 0 | 0 | 0 | 0 | 0 | 0 | 0 | 0 | 0 | 0 | 0 | 0 |
| | | 2 | 0 | 0 | 0 | 0 | 0 | 0 | 0 | 0 | 0 | 0 | 0 | 0 | 0 | 0 | 0 | 0 |
| | | 3 | 0 | 0 | 0 | 0 | 0 | 0 | 1 | 0 | 1 | 0 | 0 | 0 | 0 | 0 | 0 | 0 |

FIG.27

| | | | | | | | |
|---|---|---|---|---|---|---|---|
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |
| 1 | 1 | 1 | 1 | 0 | 0 | 0 | 0 |

FIG.28

| | | | |
|---|---|---|---|
| 4 | 0 | 4 | 0 |
| 0 | 0 | 0 | 0 |
| 4 | 0 | 4 | 0 |
| 0 | 0 | 0 | 0 |
| 4 | 0 | 4 | 0 |
| 0 | 0 | 0 | 0 |

f=0

| | | | |
|---|---|---|---|
| 0 | 0 | 0 | 0 |
| 4 | 0 | 4 | 0 |
| 0 | 0 | 0 | 0 |
| 4 | 0 | 4 | 0 |
| 0 | 0 | 0 | 0 |
| 4 | 0 | 4 | 0 |

f=1

$\xrightarrow{\int}$

| | | | |
|---|---|---|---|
| 2 | 0 | 2 | 0 |
| 2 | 0 | 2 | 0 |
| 2 | 0 | 2 | 0 |
| 2 | 0 | 2 | 0 |
| 2 | 0 | 2 | 0 |
| 2 | 0 | 2 | 0 |

FIG.29 f=0

| | | | |
|---|---|---|---|
| 4 | 0 | 4 | 0 |
| 0 | 0 | 0 | 0 |
| 4 | 0 | 4 | 0 |
| 0 | 0 | 0 | 0 |
| 4 | 0 | 4 | 0 |
| 0 | 0 | 0 | 0 |

f=1

| | | | |
|---|---|---|---|
| 0 | 0 | 0 | 0 |
| 0 | 4 | 0 | 4 |
| 0 | 0 | 0 | 0 |
| 0 | 4 | 0 | 4 |
| 0 | 0 | 0 | 0 |
| 0 | 4 | 0 | 4 |

f=2

| | | | |
|---|---|---|---|
| 0 | 4 | 0 | 4 |
| 0 | 0 | 0 | 0 |
| 0 | 4 | 0 | 4 |
| 0 | 0 | 0 | 0 |
| 0 | 4 | 0 | 4 |
| 0 | 0 | 0 | 0 |

f=3

| | | | |
|---|---|---|---|
| 0 | 0 | 0 | 0 |
| 4 | 0 | 4 | 0 |
| 0 | 0 | 0 | 0 |
| 4 | 0 | 4 | 0 |
| 0 | 0 | 0 | 0 |
| 4 | 0 | 4 | 0 |

$\int$

| | | | |
|---|---|---|---|
| 1 | 1 | 1 | 1 |
| 1 | 1 | 1 | 1 |
| 1 | 1 | 1 | 1 |
| 1 | 1 | 1 | 1 |
| 1 | 1 | 1 | 1 |
| 1 | 1 | 1 | 1 |

| | |
|---|---|
| 0 | 1 |
| 2 | 32 |

LUMINANCE RESOLUTION ENHANCEMENT CIRCUIT AND DISPLAY APPARATUS USING SAME

BACKGROUND OF THE INVENTION

The present invention relates to a luminance resolution enhancement circuit and display apparatus that employ dithering to improve the luminance resolution of an image displayed on a display device such as a plasma display panel (PDP) or digital micromirror device (DMD).

In a plasma display panel, for example, each light-emitting picture element or pixel has only an on-state and an off-state. To express shades of gray and other colors, as required for displaying video signals, each field of the video signal is divided into subfields, so that the pixels can be switched on and off more often than once per field. FIG. 1 shows an example in which a field (AF) is divided into eight subfields (SF0 to SF7), each comprising an addressing interval (AD) and a continuous firing or sustaining period (CF). During each addressing interval, one bit of data is written to every pixel on the display panel. Light emission takes place most intensely during the sustaining periods, because the phosphor coatings of the pixels are not excited during the addressing intervals and the light emission rapidly decays. For simplicity, it will be assumed below that the time constant of the decay process is short enough that substantially no light is emitted during the addressing intervals.

The lengths of the sustaining periods (CF0 to CF7) are in the ratio 1:2:4:8:16:32:64:128. Combinations of these lengths provide a luminance scale or gray scale with two hundred fifty-six levels, from zero to two hundred fifty-five (1 +2 +4 +8 +16 +32 +64 +128 =255). A luminance level of one hundred twenty-seven, for example, is expressed by driving a pixel during the first seven subfields SF0 to SF6 (1 + 2 +4 +8 +16 +32 +64 =127). Although the pixel flickers on and off seven times within the field AF, the flicker is too fast to be perceived; the human eye integrates the total on-time and reacts by seeing the desired luminance level.

Referring to FIG. 2, a conventional PDP display apparatus comprises an image signal input terminal 1, a synchronizing (sync) signal input terminal 2, an eight-bit analog-to-digital converter (ADC) 3, an inverse gamma corrector 4, a field memory unit 5, drive circuits 6, a control unit 7, and a plasma discharge panel 8. Descriptions of these elements will be given later.

The luminance resolution of this type of display can be increased by increasing the number of subfields. For example, ten subfields with sustaining periods in the ratio 1:2:4:8:16:32:64:128:256:512 provide one thousand twenty-four luminance levels. A problem, however, is that the length of the addressing intervals remains constant, so as more subfields are added, more time is needed for addressing, less time is available for firing the pixels, and the brightness of the display is correspondingly reduced.

A further problem is that all luminance levels are integer multiples of the lowest expressible luminance level, at which a pixel is driven only during the first subfield SF0. The human eye, however, is more sensitive to differences between low luminance levels than differences between high luminance levels, so a luminance resolution that is adequate for bright areas of an image may be inadequate for darker areas. When an image with continuous luminance variations is displayed on the conventional display, the variations occurring at low luminance levels tend to be perceived as discrete changes, creating unwanted contours in the image.

Solutions to these problems have been proposed, but the proposed solutions have various disadvantages.

An image displaying device described in Japanese Unexamined Patent Application No. 8-149398 adds a random signal to the image signal to disguise unwanted contours. This scheme does not actually improve the luminance resolution of the image, because the random signal is unrelated to the image signal.

A plasma display device described in Japanese Unexamined Patent Application No. 6-295161 varies the reference voltages used in analog-to-digital conversion in a predetermined pattern that varies from field to field. This scheme also disguises contours without actually increasing the luminance resolution of the image.

A DMD display system described in U.S. Pat. No. 5,726,718 uses an error diffusion filter to enhance perceived luminance resolution by propagating luminance error to nearby pixels. Error diffusion, however, has a known tendency to degrade spatial resolution, and to introduce image artifacts in certain situations.

SUMMARY OF THE INVENTION

It is accordingly an object of the present invention to improve the quality of a digital image by increasing the perceived luminance resolution.

The invented luminance resolution enhancement circuit receives an (m+n)-bit digital image signal having an m-bit displayable component and an n-bit non-displayable component, where m and n are positive integers. The luminance resolution enhancement circuit comprises address-generating means generating relative spatial and temporal coordinates that divide the image into coordinate regions and identify the relative position of each pixel within its coordinate region. For each pixel in the image, an averaging means calculates an average value representing the non-displayable component of the average luminance level in an averaging region including the pixel. A dithering means generates a dither signal according to the relative spatial and temporal coordinates of the pixel and the calculated average value. An arithmetic means additively combines the dither signal with the displayable component of the image signal, thereby generating an m-bit output image signal.

The dither signal simulates the non-displayable component of the image signal by generating a proportional number of 1's within a dither region of a certain size. The dither region may extend in the temporal dimension, as well as in the spatial dimensions. The size of the averaging region can be selected independently of the size of the dither region, but in one aspect of the invention, the dither region and averaging region are identical, and both are identical to a unit region within which the same average value is calculated for all pixels. This aspect of the invention assures faithful simulation of the average luminance level within the unit region.

In another aspect of the invention, the unit region and averaging region are identical, but the dither region is larger. The size of the dither region may be enlarged to obtain increased luminance resolution. Alternatively, the size of the unit region and averaging region may be reduced to obtain increased spatial resolution.

In another aspect of the invention, the averaging region and unit region are restricted to pixels with luminance levels not differing by more than a predetermined threshold value. Increased sharpness is thereby obtained.

In another aspect of the invention, the dither signal is also responsive to an external signal. The external signal can be used to select different dither patterns for still and moving images.

In another aspect of the invention, the number of bits of simulated luminance resolution is varied according to the luminance level. For example, increasing numbers of most significant bits of the average signal can be used as the luminance level decreases.

The invention also provides a display apparatus using the invented luminance resolution enhancement circuit. The display apparatus may include an inverse gamma corrector that converts the image signal so as to provide additional luminance resolution at lower luminance levels, before the image signal is processed by the luminance resolution enhancement circuit.

BRIEF DESCRIPTION OF THE DRAWINGS

In the attached drawings:

FIG. 7 shows an example of pixel values in an averaging region;

FIG. 8 illustrates the operation of the dither signal generator in FIG. 4;

FIG. 9 illustrates luminance levels in an image signal received by the luminance resolution enhancement circuit in FIG. 4;

FIG. 10 illustrates an intermediate stage of the process performed by the weighted averaging circuit in FIG. 4;

FIG. 11 illustrates the final result of the weighted averaging process;

FIGS. 12A and 12B illustrate the image signal output by the luminance resolution enhancement circuit;

FIG. 13 illustrates visual integration of this image signal;

FIG. 22 illustrates the operation of the dither signal generator in the fifth embodiment;

FIG. 23 illustrates a variation of the operation shown in FIG. 22;

FIG. 27 illustrates a first frame in an image having a moving vertical band;

FIG. 28 illustrates the display of this moving band when the dither pattern in FIG. 25 is used;

FIG. 29 illustrates the display of this moving band when the dither pattern in FIG. 26 is used;

DETAILED DESCRIPTION OF THE INVENTION

Figure 1:
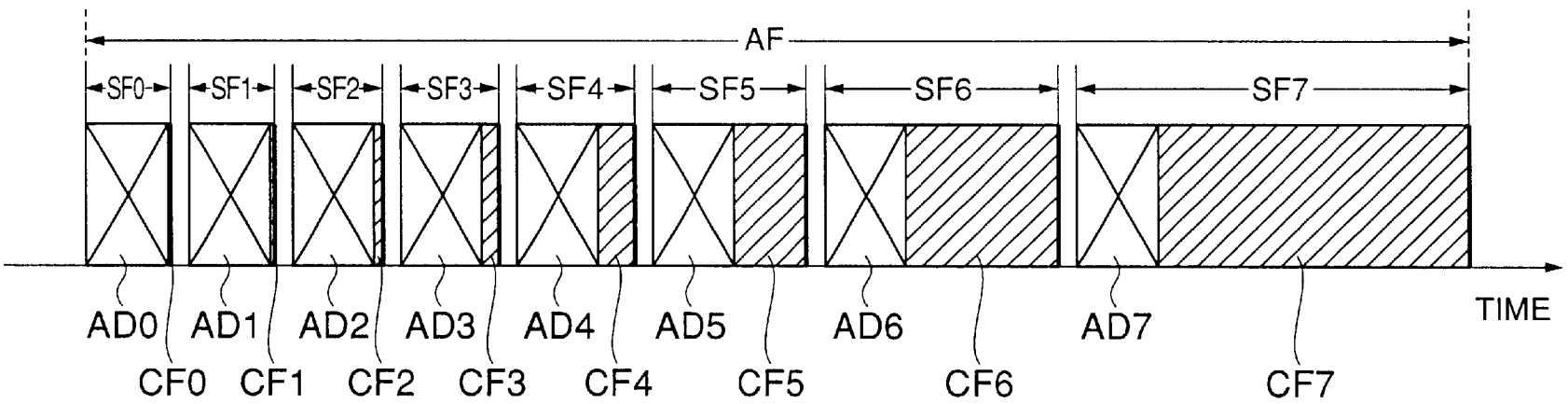
FIG.1 PRIOR ART
FIG. 1 illustrates the display of subfields within a field.

Embodiments of the invention will be described with reference to the attached drawings, in which like parts are indicated by like reference characters.

Figure 2:
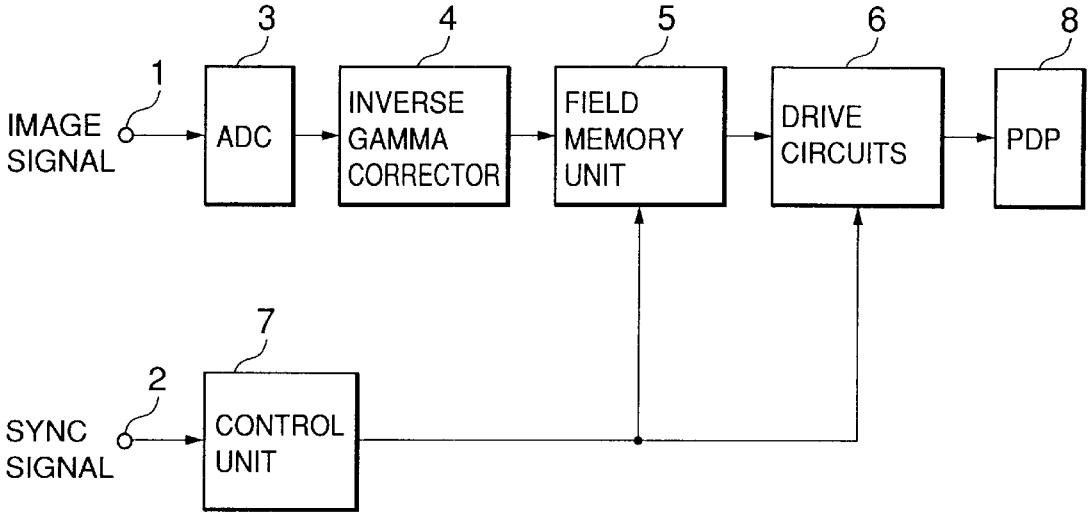
FIG.2 PRIOR ART
FIG. 2 is a block diagram of a conventional PDP display apparatus.
Figure 3:
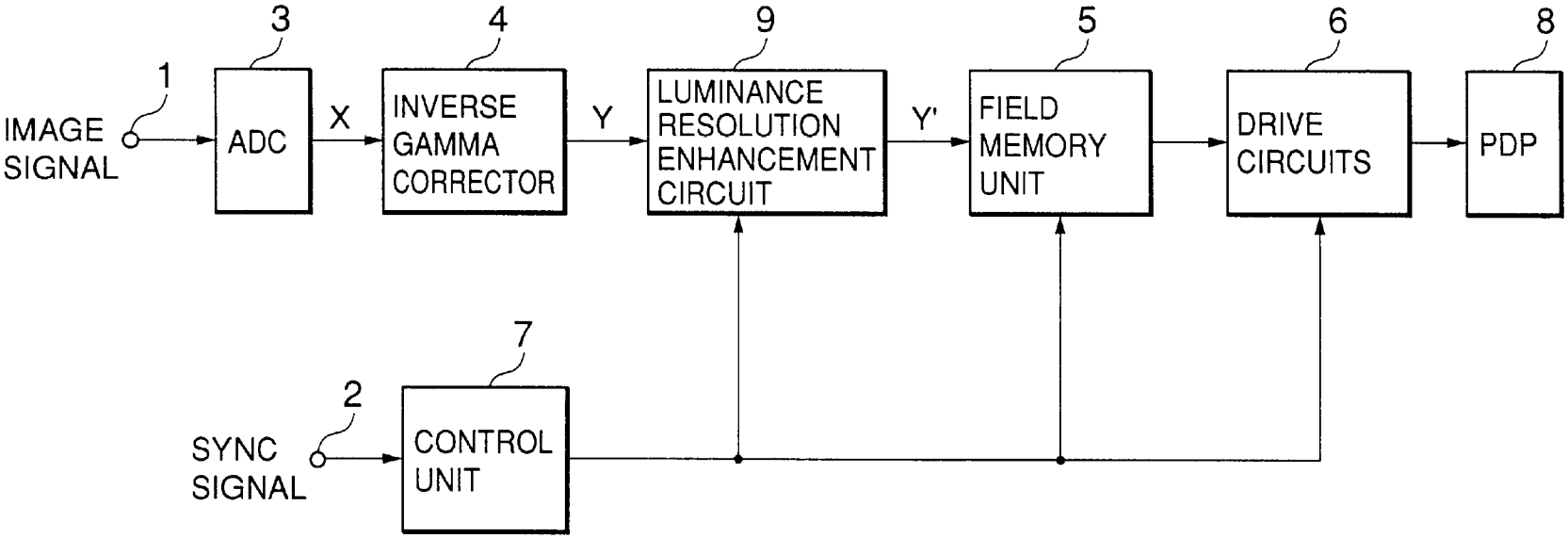
FIG. 3 is a block diagram of a PDP display apparatus illustrating a first embodiment of the invention.

Illustrating a first embodiment of the invention, FIG. 3 shows a display apparatus having a luminance resolution enhancement circuit 9 in addition to the other elements present in FIG. 2. Differing from the ADC in FIG. 2, the ADC 3 in the first embodiment is a ten-bit analog-to-digital converter.

The image signal and synchronizing signal received at the input terminals 1, 2 constitute an analog video signal output from a television broadcasting station or other source. The analog-to-digital converter 3 converts the image signal to a ten-bit digital signal X.

The inverse gamma corrector 4 adjusts the luminance levels of the digital image signal X according to an inverse gamma function, thereby removing a gamma correction applied at the signal source and converting the luminance levels so that they will be correctly reproduced by the plasma display panel 8. The output of the inverse gamma corrector 4 is a digital image signal Y with ten bits per pixel, which is more than the number of bits actually displayed on the plasma display panel 8. The eight most significant bits will be referred to below as the displayable component (m =8). The two least significant bits will be referred to as the non-displayable component (n =2).

The luminance resolution enhancement circuit 9 performs a dithering process that will be described below, converting the ten-bit digital image signal Y to an eight-bit digital image signal Y' that is written into the field memory unit 5.

The field memory unit 5 comprises two field memories that are used alternately, one being written to while the other is being read. The field memory unit 5 thus has a total capacity of two fields.

The drive circuits 6 read one bit plane at a time from the field memory unit 5, and write the written data to the plasma display panel 8. After writing one bit to every pixel in the plasma display panel 8, the drive circuits 6 fire the pixels.

These two operations constitute the display of one subfield. They are repeated for eight subfields per field.

The control unit 7 controls and synchronizes the operations of the luminance resolution enhancement circuit 9, field memory unit 5, and drive circuits 6. In particular, the control unit 7 controls the durations of the sustaining periods so that within each field, these durations double from one subfield to the next.

The plasma display panel 8 is an alternating-current panel that retains the data written in one pixel while the drive circuits 6 are writing data to other pixels. When fired, the pixels in which 1's have been written emit light simultaneously.

Figure 4:
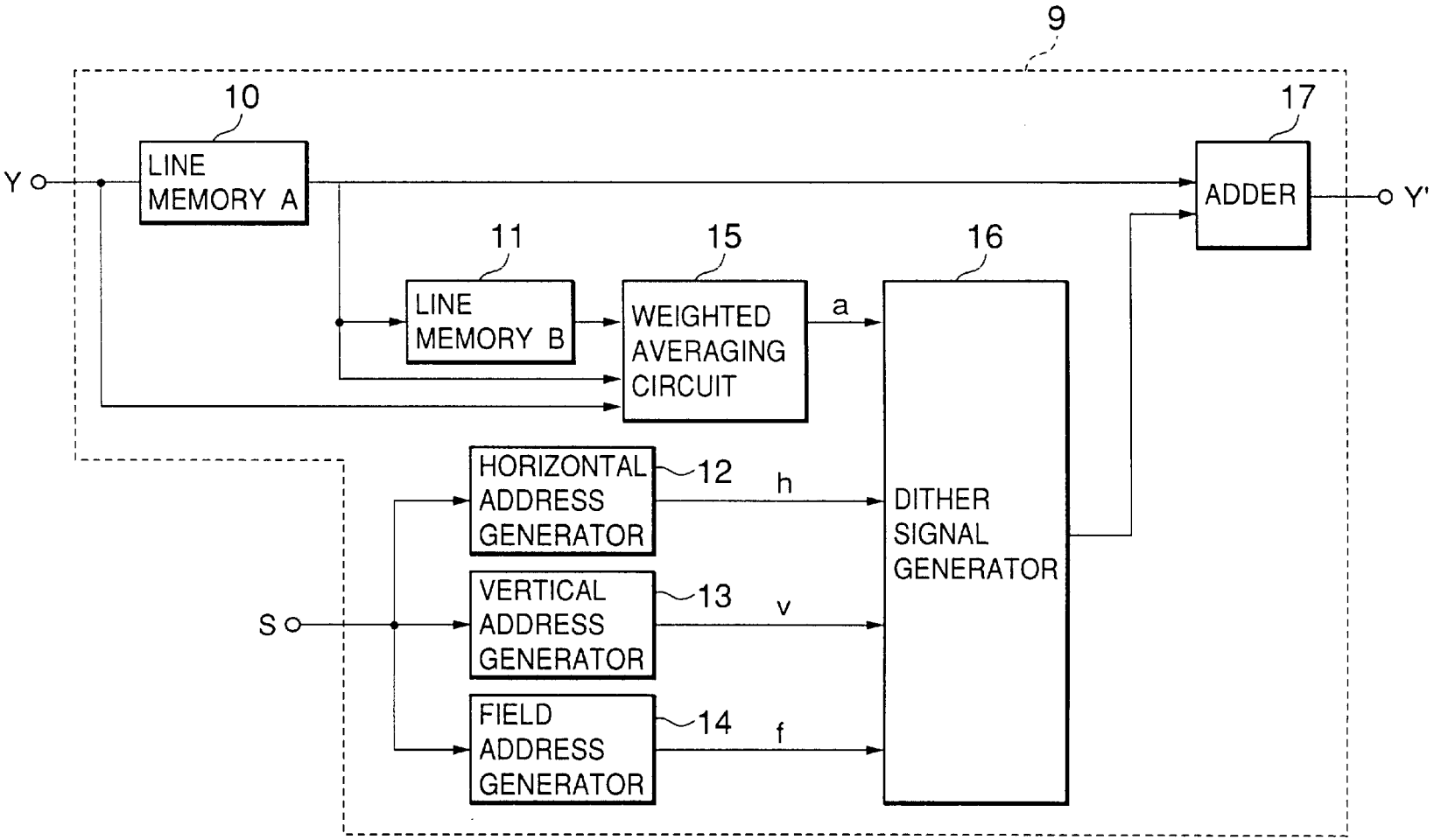
FIG. 4 is a more detailed block diagram of the luminance resolution enhancement circuit in FIG. 3.

Referring to FIG. 4, the luminance resolution enhancement circuit 9 comprises a pair of line memories 10, 11, a horizontal address generator 12, a vertical address generator 13, a field address generator 14, a weighted averaging circuit 15, a dither signal generator 16, and an adder 17.

The first line memory 10, referred to below as line memory A, stores the values of one line of pixels of the signal output from the inverse gamma corrector 4. In the following description, the line will be horizontal, although the invention can also be practiced by storing vertical lines. Line memory A stores both the displayable and non-displayable components of the pixel values.

The second line memory 11, referred to below as line memory B, stores the non-displayable components of the pixel values read from line memory A.

The horizontal address generator 12 and vertical address generator 13 generate relative coordinates in the horizontal and vertical spatial directions, according to control signals S output by the control unit 7. The field address generator 14 generates relative coordinates in the temporal direction, the coordinate values identifying fields on the time axis. Each of the address generators 12, 13, 14 comprises a one-bit counter, generating relative coordinate values of zero and one.

The weighted averaging circuit 15 receives the non-displayable components of the pixel values input to line memory A, output from line memory A, and output from line memory B. For each pixel in the image, in each field, the averaging circuit 15 calculates a weighted average of the non-displayable component of the image signal in a three-by-three region centered on the pixel.

The dither signal generator 16 comprises a cascaded series of selectors that use this weighted average and the relative coordinates output by the address generators 12, 13, 14 to generate a one-bit dither signal. The adder 17 adds this dither signal to the displayable component of the image signal received from line memory A to generate the output signal Y'. If the displayable component received from line memory A has the maximum value (255), however, the output signal Y' also has the maximum value (255).

Next, the operation of the first embodiment will be described.

The analog signal received at the image signal input terminal 1 is processed by the analog-to-digital converter 3, inverse gamma corrector 4, and luminance resolution enhancement circuit 9 to produce an eight-bit digital image signal Y', which is stored in the field memory unit 5. The eight bits will be denoted $b_0$ to $b_7$, where $b_0$ is the least significant bit and $b_7$ is the most significant bit. The drive circuits 6 drive the plasma display panel 8 so as to display each field stored in the field memory unit 5 in the manner shown in FIG. 1, the eight bit planes from $b_0$ to $b_7$ being displayed as subfields SF0 to SF7. The lengths of the sustaining periods CF0 to CF7 are in the ratio 1:2:4:8:16:32:64:128, providing a luminance scale with two hundred fifty-six discrete levels.

When the first subfield SF0 is displayed, the drive circuits 6 read the $b_0$ data for each pixel from the field memory unit 5 and write these data to the plasma display panel 8 during the addressing interval ADO, then fire the pixels continuously during the sustaining period CFO. The pixels in which '1' was written emit light during interval CFO. Next, subfield SF1 is displayed in the same way, the bi data being written during the addressing interval AD1, and pixels in which '1' is written emitting light during sustaining period CF1, which is twice as long as sustaining period CFO. The remaining subfields SF2 to SF7 are similarly displayed, the lengths of the sustaining periods doubling with each subfield.

The field rate is fast enough that the eye does not perceive the individual sustaining periods, but integrates the emitted light into an image in which the pixels appear to have steady luminance levels.

The operation of the luminance resolution enhancement circuit 9 will now be described in more detail.

The ten-bit digital image signal Y received from the inverse gamma corrector 4 is first stored in line memory A, one line at a time. The non-displayable component, comprising the two least significant bits, is output from line memory A to line memory B and the weighted averaging circuit 15. The displayable component, comprising the eight most significant bits, is output from line memory A to the adder 17. Line memory A is controlled to operate as a one-line delay element; there is a one-line delay from the writing of a pixel value into line memory A to the reading of the same pixel value from line memory A. Line memory B also operates as a one-line delay element.

Figure 5:
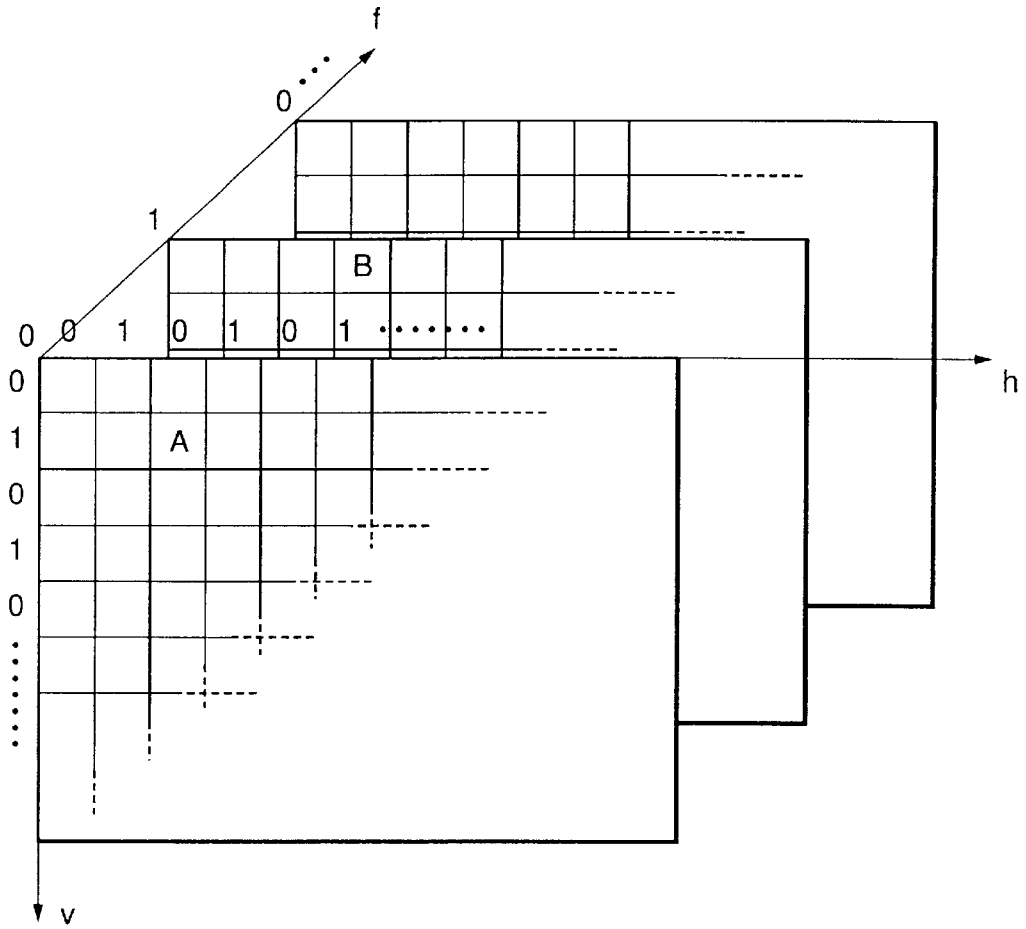
FIG. 5 illustrates relative spatial and temporal coordinates.

The horizontal address generator 12 is controlled by a horizontal synchronizing signal and pixel clock signal received from the control unit 7, being reset to zero at the beginning of each horizontal line and toggling between zero and one at each pixel in the line. The vertical address generator 13 is controlled by the horizontal synchronizing signal and a vertical synchronizing signal received from the control unit 7, being reset to zero at the top of each field and toggling once per horizontal line. The field address generator 14 is controlled by the vertical synchronizing signal received from the control unit 7, toggling once per field. The relative coordinates output by these address generators are shown in FIG. 5. Each pixel value has a relative horizontal coordinate (h), a relative vertical coordinate (v), and a relative field coordinate (f). For the pixel value at spatial-temporal position A, for example, the (h, v, f) values are (0, 1, 0). For the pixel value at spatial-temporal position B, (h, v, f) =(1, 0, 1).

Each field can be divided into non-overlapping two-by-two coordinate regions as indicated by the dark lines in FIG. 5. The two spatial coordinates (h, v) uniquely identify the relative position of each pixel within its coordinate region. If the temporal dimension is included, then the image is divided into two-by-two-by-two spatial-temporal coordinate regions, the three relative coordinates (h, v, f) uniquely identifying the position of each pixel value within its region.

Figure 6:
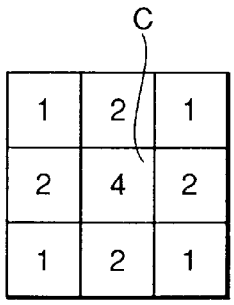
FIG. 6 illustrates weights used in obtaining a weighted average.

For each pixel C in each field, the averaging circuit 15 calculates a weighted average of the non-displayable components of the pixel value and the values of the eight neighboring pixels in the same field, using the weights shown in FIG. 6. The pixel itself has a weight of four; the adjacent pixels above, below, and to the left and right have weights of two; the four diagonally adjacent pixels have weights of one.

These nine pixels constitute an averaging region centered on the pixel C. The weighted average calculated from this averaging region is applied only to the pixel C; that is, the unit region to which a single average value is applied is a one-by-one region consisting of just one pixel. If the temporal dimension is included, the unit region is a one-by-one-by-one region consisting of a single pixel value, and the averaging region is a three-by-three-by-one region comprising nine pixel values.

If, for example, the non-displayable components of the nine pixels in the averaging region have the values in FIG. 7, their weighted average is calculated as follows. The central pixel value of three is multiplied by a weight of four to obtain a weighted value of twelve (3×4=12). The pixel to the left has a value of two, which is multiplied by a weight of two to obtain a weighted value of four (2×2=4). The bottom left and top right pixels each have values of one, which are multiplied by weights of one to obtain weighted values of one (1×1=1). The other pixels have zero non-displayable components, hence weighted values of zero. The sum of the weighted values (12+4+1+1=18) is divided by the sum of the weights (4+2+2+2+2+1+1+1+1=16), giving a weighted average value of one and one-eighth (1.25 in decimal notation). This result is rounded off to the nearest integer value (1). The division and rounding operations can be carried out as a right shift and addition, which are easily performed by hardware.

For each pixel in each field, the dither signal generator 16 receives the relative horizontal coordinate (h) from the horizontal address generator 12, the relative vertical coordinate value (v) from the vertical address generator 13, the relative temporal coordinate (f) from the field address generator 14, and the average value (a) calculated by the weighted averaging circuit 15. The dither signal generator 16 generates a dither signal from these values as shown in FIG. 8. The dither signal takes values of zero or one according to the (h, v, f, a) values. For example, if (h, v, f, a) is (0, 1, 0, 1), the value of the dither signal is zero. If (h, v, f, a) is (1, 0, 1, 2), the value of the dither signal is one. The zero and one levels of the dither signal correspond to the two lowest displayable luminance levels, zero corresponding to black and one to the lowest non-black luminance level, or to the shortest sustaining period CFO. The dither signal thus corresponds to the least significant bit of the displayable component of the image signal.

If the averaging circuit 15 continuously obtains the same non-zero value (a) for all pixels, the dither signal generated in FIG. 8 repeats the same pattern of values at intervals of two pixels in the horizontal direction, two pixels in the vertical direction, and two fields in the temporal direction. That is, a two-by-two-by-two repeating pattern, referred to below as a dither pattern, is created.

To illustrate the cyclic nature of the dither pattern, suppose that the averaging circuit 15 continuously obtains a weighted average value (a) of three. In a field with a relative field coordinate (f) of zero, the dither signal has values of one when the relative spatial coordinates (h, v) are (0, 0), (1, 0), and (1, 1), and a value of zero when the spatial coordinates (h, v) are (0, 1). This pattern is repeated in each of the two-by-two spatial coordinate regions shown in the even-numbered fields (f =0) in FIG. 5. A slightly different two-by-two dither pattern is repeated in each odd-numbered field (f =1).

The number of 1's of this dither signal in each two-by-two spatial coordinate region is equal to the weighted average value (a), both being equal to three. Similar equalities hold true for the other weighted average values (a=0, 1, 2), and these equalities hold regardless of whether the relative field coordinate (f) is equal to zero or one.

Each two-by-two spatial coordinate region is therefore also a 'dither region' in which the dither signal generator 16 simulates a non-displayable luminance level by generating a proportional number of 1's. For example, a luminance level equal to three-fourths of the minimum non-black displayable level is simulated by generating 1's for three of the four constituent pixels in the dither region. If the temporal dimension is included, then each two-by-two-by-one spatial-temporal region is a dither region in which a non-displayable luminance level (a) is accurately simulated.

The adder 17 adds the dither signal output by the dither signal generator 16 to the displayable component of the image signal output from line memory A. The zero or one value of the dither signal is added to the least significant bit of the eight bits of the displayable component of the image signal. The sum is output to the field memory unit 5. For example, if the dither signal is '1' and the displayable component of the image signal is '10010011' in binary notation, then the output Y' of the adder 17 is '10010100.'

By dithering the displayable component of the image signal in this way, the luminance resolution enhancement circuit 9 simulates the non-displayable component. This enables the image signal output from the luminance resolution enhancement circuit 9 to reproduce smooth gradations in luminance level, as will be illustrated next for the hypothetical case of a six-by-eight-pixel image.

FIG. 9 shows a ten-bit image signal output from the inverse gamma corrector 4 in which the luminance level grades from zero (black) in the first two columns to one in the next two columns, two in the next two columns and three in the last two columns. This gradation takes place in the non-displayable component of the image signal, the value of the two least significant bits increasing from '00' to '11.'The displayable component is zero throughout the image.

For averaging purposes, the pixel values in the outermost rows and columns are copied to imaginary pixels disposed just outside the image area, as shown. For example, the zero value of the pixel in the top left corner of the image is copied to three imaginary pixels disposed above, to the left, and diagonally above and to the left of that corner. The weighted averaging circuit 15 uses these imaginary pixel values to obtain a three-by-three averaging region even for pixels at the edges of the image. For example, the following weighted average value is obtained for the pixel in the first row and second column:

$$\{(1\times1)+(2\times1)+(1\times1)\}/16=0.25$$

In binary notation, this value is expressed as 0.01. If truncated after the first fraction bit, the value becomes 0.0, as shown in FIG. 10. The same weighted average is obtained for all pixels in the second column.

In the third column of pixels, similar calculations produce a weighted average value of $^{12}/_{16}$, or 0.11 in binary notation. If truncated after the first fraction bit, this value becomes 0.1 in binary notation, or 0.5 in decimal notation, as shown in FIG. 10.

The averaging circuit 15 rounds the values shown in FIG. 10 off to the nearest integer, obtaining the results shown in FIG. 11. Fractional values equal to or greater than one-half are rounded up; fractional values less than one-half are rounded down. In this example, the weighted average values (a) in FIG. 11 are identical to the pixel values in FIG. 9, although this will not be true in general.

As noted above, the displayable component of the image signal in FIG. 9 is zero. The image signal stored in the field memory unit 5 is therefore identical to the dither signal. FIG. 12A shows the image signal produced in fields with relative field coordinates (f) of zero. FIG. 12B shows the image signal produced in fields with relative coordinates of one. Instead of showing the dither signal levels of zero and one, FIGS. 12A and 12B show the corresponding luminance levels of zero and four on a ten-bit luminance scale in which the two least significant bits are zero.

A comparison of the signals input (FIG. 9) and output (FIGS. 12A and 12B) by the luminance resolution enhancement circuit 9 shows that for all pixels, the output value is approximately equal to the input value. Furthermore, in this example, the average input pixel value in each of the non-overlapping two-by-two spatial dither regions is exactly equal to the average output value in the same two-by-two region.

The human eye does not perceive the fields shown in FIGS. 12A and 12B separately, but integrates them and perceives the time-averaged luminance levels shown in FIG. 13. Since the individual pixels are normally too small to be perceptible, the eye also performs spatial integration and perceives the average luminance level of a plurality of pixels. If each non-overlapping two-by-two region in FIG. 13 is averaged in this way, the perceived image is identical to the input image shown in FIG. 9.

The first embodiment thus reproduces spatial intensity gradations that could not be reproduced by conventional display apparatus using an eight-bit luminance scale without dithering. In the conventional display apparatus, all pixels in the image would be black.

The first embodiment can also reproduce temporal gradations that could not be reproduced by the conventional display apparatus, by gradually increasing the number of 1's output in the dither signal from one field to the next.

When sudden changes in luminance level occur, as at scene changes, the averaging circuit 15 may obtain different average values (a) for the same pixel in fields with relative coordinates (f) of zero and one, and temporal integration does not necessarily produce results analogous to those illustrated in FIGS. 12A, 12B, and 13. At scene changes, however, the human visual sense does not have time to respond to the subtle luminance differences produced by dithering. Rather, it is persistent gradual luminance variations that are noticed, especially gradual variations in the spatial directions, and it is these gradual variations that the first embodiment succeeds in reproducing.

In a variation of the first embodiment, dithering is performed selectively. For example, circuits for detecting gradual variations are added, and dithering is carried out only when gradual variations are detected. Alternatively, circuits for detecting abrupt changes are added, and dithering is suppressed when abrupt changes are detected.

In another variation, the luminance scale is reversed so that zero corresponds to white. In this case the adder 17 is replaced by a subtractor that subtracts the dither signal from the image signal. The meaning of 'additive combination' includes both addition and subtraction.

The first embodiment is not limited to the region sizes and dither patterns shown in the drawings. For example, the size of the coordinate regions can be increased by increasing the number of counter bits in one or more of the address generators 12, 13, 14. The shape of the coordinate regions is also arbitrary, and it is not strictly necessary for the pixels in each coordinate region to be contiguous. The size and shape of the dither regions in which non-displayable luminance levels are simulated by a proportional number of 1's can also be varied. Dither regions and dither patterns of different sizes can be used according to the weighted average value. For example, a four-by-four spatial dither pattern can be employed when the weighted average value (a) is equal to one, two-by-two dither patterns being employed for the other average values.

The number of 1's of the dither signal need not be exactly equal to the average non-displayable luminance level. In the general case, when the same average non-displayable luminance level (a) is calculated for every pixel in a dither region, the average luminance level of the dither signal is substantially proportional to that average non-displayable luminance level (a), with a precision that depends on the number of non-displayable bits and the size of the dither region.

The averaging region may also have an arbitrary size and shape, which can be selected independently of the size and shape of the coordinate regions and dither regions. Moreover, instead of a weighted averaging scheme such as shown in FIG. 6, simple averaging can be employed, by making all weights equal. Furthermore, the averaging circuit can output the sum of the weighted or non-weighted pixel values, instead of their average. The invention can thus be practiced using a weighted average, a simple average, a weighted sum, or a simple sum. When a weighted average or simple average is used, the rounding operation described above can be replaced with another type of rounding operation.

Next, a second embodiment will be described. The second embodiment has the overall configuration shown in FIG. 3, but differs from the first embodiment in the internal structure of the luminance resolution enhancement circuit 9.

Figure 14:
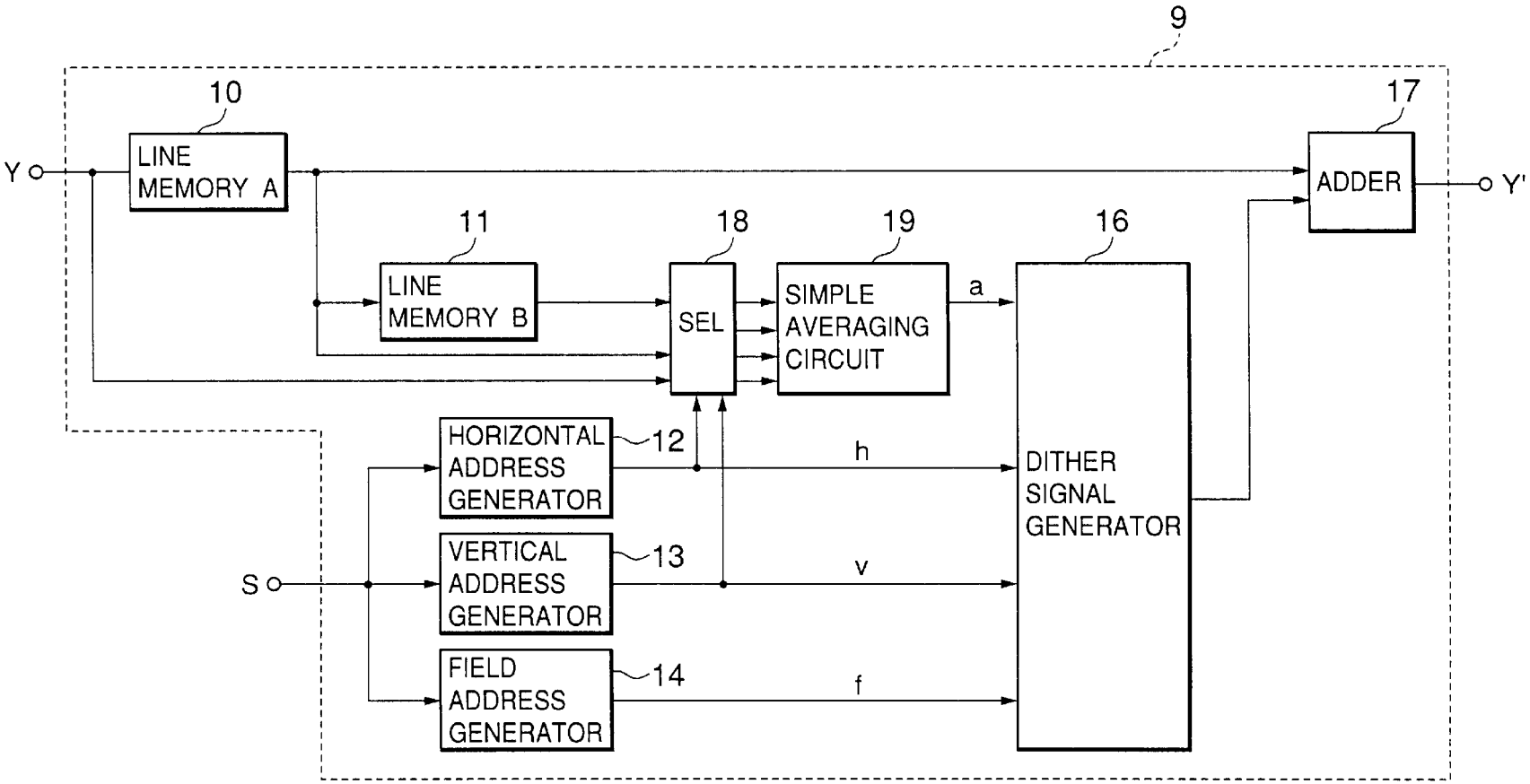
FIG. 14 shows the internal structure of the luminance resolution enhancement circuit in a second embodiment of the invention.

Referring to FIG. 14, the luminance resolution enhancement circuit 9 in the second embodiment replaces the weighted averaging circuit of the first embodiment with a selector (SEL) 18 and a simple averaging circuit 19. The selector 18 uses the relative spatial coordinates output by the horizontal address generator 12 and vertical address generator 13 to select the non-displayable components of four pixel values supplied from the inverse gamma corrector 4 and line memories A and B. The luminance resolution enhancement circuit 9 calculates the simple average of the selected values.

Pixel values are stored in line memories A and B as described in the first embodiment. When the simple averaging circuit 19 calculates an average value (a) for a pixel D, the selector 18 selects the non-displayable components of the values of four pixels in a two-by-two region including pixel D. When the relative spatial coordinates (h, v) of pixel D are (0, 0), selector 18 selects the two-by-two region comprising pixels 40, 41, 42, 43 shown in FIG. 15A, pixel D in this case being the pixel 40 in the upper left corner. When the relative spatial coordinates (h, v) of pixel D are (1, 0), (0, 1), and (1, 1), selector 18 selects the two-by-two regions shown in FIGS. 15B, 15C, and 15D, respectively.

The dither signal generator 16 operates as in the first embodiment.

The operation of the second embodiment will be described for the four pixels shown in FIG. 16. The illustrated pixel values are ten-bit values which can be normalized by dividing by $2^{10}$ (1024). That is, the illustrated values indicate luminance levels equal to $1/1024$, $2/1024$, and $3/1024$ of a theoretical maximum luminance level. The pixel values shown in FIG. 16 belong to the non-displayable component of the image signal.

Figure 15A:
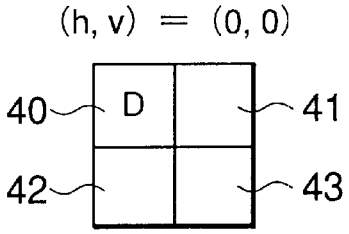
FIGS. 15A, 15B, 15C, and 15D illustrate spatial regions selected by the selector in FIG. 14.
Figure 16:
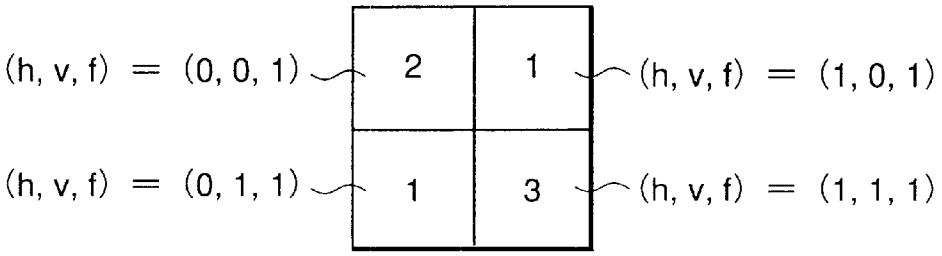
FIG. 16 shows an example of pixel values in a two-by-two region.

When the pixel in the upper left corner in FIG. 16, having relative spatial and temporal coordinates (0, 0, 1), is processed, the selector 18 selects the two-by-two region shown in FIG. 15A. This region coincides with the two-by-two region shown in FIG. 16. The selector 18 supplies the averaging circuit 19 with the values of the non-displayable components of the four pixels in this region, which are the values (2, 1, 1, 3) shown in FIG. 16. The averaging circuit 19 calculates their average as (2+1+1+3)/4 or 7/4, which is rounded off to two (2). The dither signal generator 16 receives relative spatial and temporal coordinates and an average value (h, v, f, a) equal to (0, 0, 1, 2). From FIG. 8, the dither signal level is equal to zero.

Figure 15B:
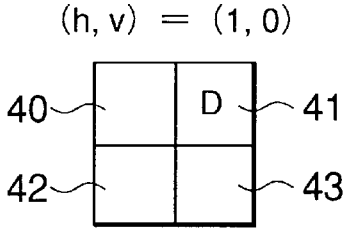
Figure 15C:
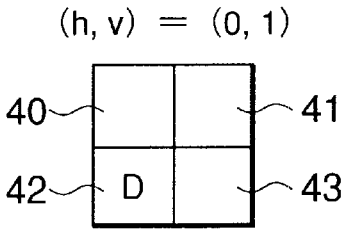

When the pixel in the upper right corner in FIG. 16, having relative spatial and temporal coordinates (1, 0, 1), is processed, selector 18 selects the two-by-two region in FIG. 15B. This region also coincides with the region shown in FIG. 16. The selector 18 supplies the averaging circuit 19 with the same values (2, 1, 1, 3) as before, and the averaging circuit 19 obtains the same rounded average value of two (2). The dither signal generator 16 receives spatial and temporal coordinates and an average value (h, v, f, a) equal to (1, 0, 1, 2). From FIG. 8, the dither signal level is equal to one.

When the pixel in the lower left corner in FIG. 16, having relative spatial and temporal coordinates (0, 1, 1), is processed, selector 18 selects the two-by-two region shown in FIG. 15C, which again coincides with the region in FIG. 16. The averaging circuit 19 receives the same values (2, 1, 1, 3) once more, and obtains a rounded average value of two (2) again. The dither signal generator 16 receives values (h, v, f, a) equal to (0, 1, 1, 2), and generates a dither signal level equal to one.

Figure 15D:
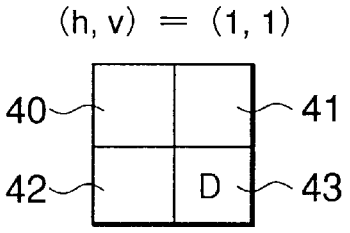

When the pixel in the lower right corner in FIG. 16, having relative spatial and temporal coordinates (1, 1, 1), is processed, selector 18 selects the two-by-two region in FIG. 15D, which also coincides with the region shown in FIG. 16. The averaging circuit 19 calculates the same rounded average value of two (2) for a fourth time. The (h, v, f, a) values of (1, 1, 1, 2) produce a dither signal level equal to zero.

In the second embodiment, the unit region throughout which the same average value is calculated and applied is identical to the averaging region itself, and both regions are identical to the two-by-two dither regions.

The eight-bit displayable component of the image signal received by the adder 17 has a value of zero for all four of the pixels shown in FIG. 16. The eight-bit values Y' output by the adder 17 are therefore the same as the dither signal values: zero for the pixels in the top left and bottom right corners in FIG. 16, and one for the other two pixels. These values can be normalized by dividing by $2^8$ (256). The adder 17 outputs four pixel values with normalized luminance levels of 0/256, 1/256, 1/256, and 0/256. The average normalized luminance level of these pixels is 2/1024 or 8/4096.

The average normalized luminance level of the input pixel values in FIG. 16 can be calculated as follows.

$$\{(2+1+1+3)/1024\}/4=7/4096$$

This value is substantially equal to their average level (8/4096) in the output signal Y'. If both average values (7/4096 and 8/4096) are rounded off to the nearest ten-bit values, they become exactly equal (both become 2/1024).

Because of the equality of the unit regions, averaging regions, and dither regions in the second embodiment, this is true in general. The rounded average value of the non-displayable component of the image signal in each two-by-two unit region is always equal to the number of 1's generated by the dither signal generator 16 in this region. The average luminance level of the non-displayable component in each unit region is substantially equal to the average luminance level of the dither signal in the same unit region. As a result, when all four pixels in a unit region have the same displayable (eight-bit) luminance level, the second embodiment faithfully reproduces the average ten-bit luminance level of each unit region, rendering both the displayable and non-displayable components without introducing image artifacts, regardless of the values of the image signal output by the inverse gamma corrector 4.

In the example above, the unit regions, averaging regions, and dither regions were two-by-two spatial regions, but it is possible to use regions of other sizes, and these regions may extend in the temporal dimension as well as the spatial dimensions.

The coordinate regions generated by the address generators 12, 13, 14 may be larger than the unit regions, averaging regions, and dither regions in the spatial dimensions, as well as the temporal dimension, permitting the dither pattern to have a larger spatial extent than the dither region size. For example, a four-by-four spatial dither pattern comprising four different two-by-two sub-patterns, each faithfully simulating the average luminance a level in a two-by-two unit region, may be employed.

The second embodiment provides effects similar to those of the first embodiment in expressing gradual intensity variations. For example, if applied to the image shown in FIG. 9, the second embodiment produces the same result as the first embodiment. In some cases, there is a slight loss of spatial resolution in the simulation of the non-displayable component, because a single average value is used for an entire two-by-two unit region, but this is balanced by the improved faithfulness of the simulation of the average luminance levels in the unit regions. The displayable component of the image signal is still displayed with full one-pixel spatial resolution.

Next, a third embodiment will be described. The third embodiment is identical to the second embodiment, except for the operation of the dither signal generator 16.

Figures 17, 18:
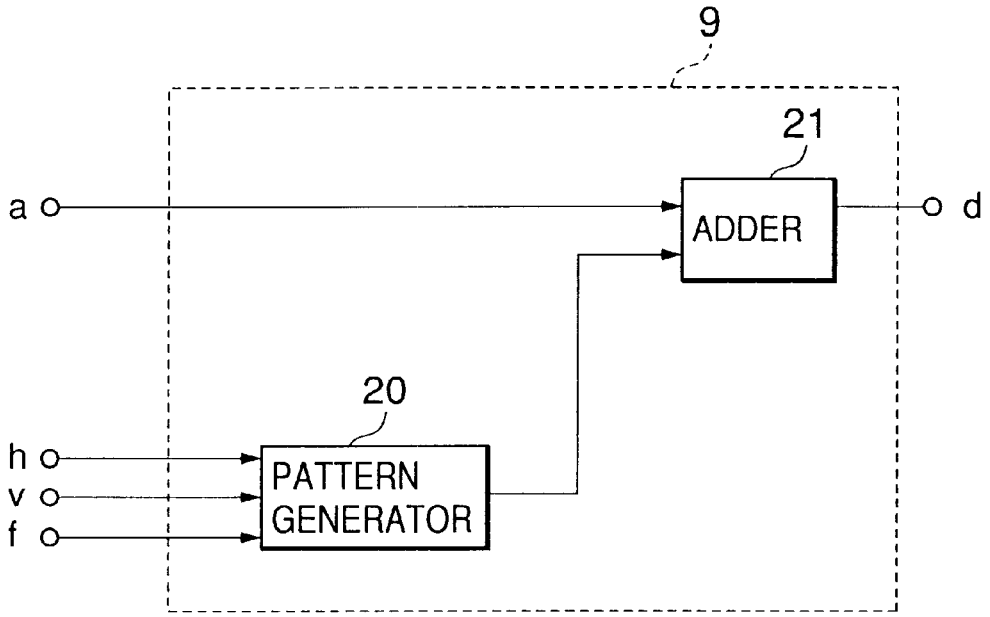
FIG. 17 is a block diagram of the dither signal generator in a third embodiment of the invention.
FIG. 18 illustrates the operation of the pattern generator in FIG. 17.

FIG. 17 shows the internal structure of the dither signal generator 16 in the third embodiment. A pattern generator 20 receives the relative horizontal coordinate (h) from the horizontal address generator 12, the relative vertical coordinate (v) from the vertical address generator 13, and the relative temporal coordinate (f) from the field address generator 14, and generates a two-bit pattern signal. This pattern signal is added to the two-bit average value (a) received from the simple averaging circuit 19 to generate a one-bit dither signal. The addition is performed by a three-bit adder 21.

FIG. 18 illustrates the operation of the pattern generator 20. When supplied with relative spatial and temporal coordinates (h, v, f) equal to (0, 0, 0), for example, the pattern generator 20 outputs the value three. When supplied with coordinates (h, v, f) equal to (1, 0, 1), the pattern generator 20 outputs the value two.

The adder 21 adds the pattern value output by the pattern generator 20 to the average value (a) received from the simple averaging circuit 19, obtaining a three-bit result with a value from zero to six. The two least significant bits of this result are discarded; only the most significant bit is used as the output dither signal (d). For example, if the pattern value is three and the average value (a) is two, the adder 21 obtains a sum of five (binary '101') and outputs the most significant bit '1' as the dither signal (d).

With four exceptions, the dither signal (d) generated in the third embodiment has the same levels as the dither signal generated in the second embodiment. Two exceptions occur when the dither signal generator receives (h, v, f, a) values equal to (0, 1, 1, 1), generating '0' in the second embodiment but '1' in the third embodiment, and (1, 1, 1, 1), generating '1' in the second embodiment but '0' in the third embodiment. Referring to FIG. 8, the '1' in the dither pattern generated when the average value (a) and relative field coordinate (f) are both equal to one is shifted from the lower right corner to the lower left corner of the corresponding two-by-two dither region. The other two exceptions occur when (h, v, f, a) is equal to (0, 0, 1, 3) and (1, 0, 1, 3), shifting the position of the '0' in the dither signal when the average value (a) is three and the field coordinate (f) is one.

The third embodiment reduces the number of selectors required in the dither signal generator. The dither signal generator of the third embodiment can also be applied in the first embodiment.

In a variation of the third embodiment, the adder 21 is replaced by a comparator that compares the average value (a) received from the averaging circuit 19 with the pattern value received from the pattern generator 20, generating a dither signal level of one when the average value is greater than the pattern value, and a dither signal level of zero when the average value is equal to or less than the pattern value.

Next, a fourth embodiment will be described. The fourth embodiment has the overall structure shown in FIG. 3, but differs from the first and second embodiments in the internal structure of the luminance resolution enhancement circuit 9.

Figure 19:
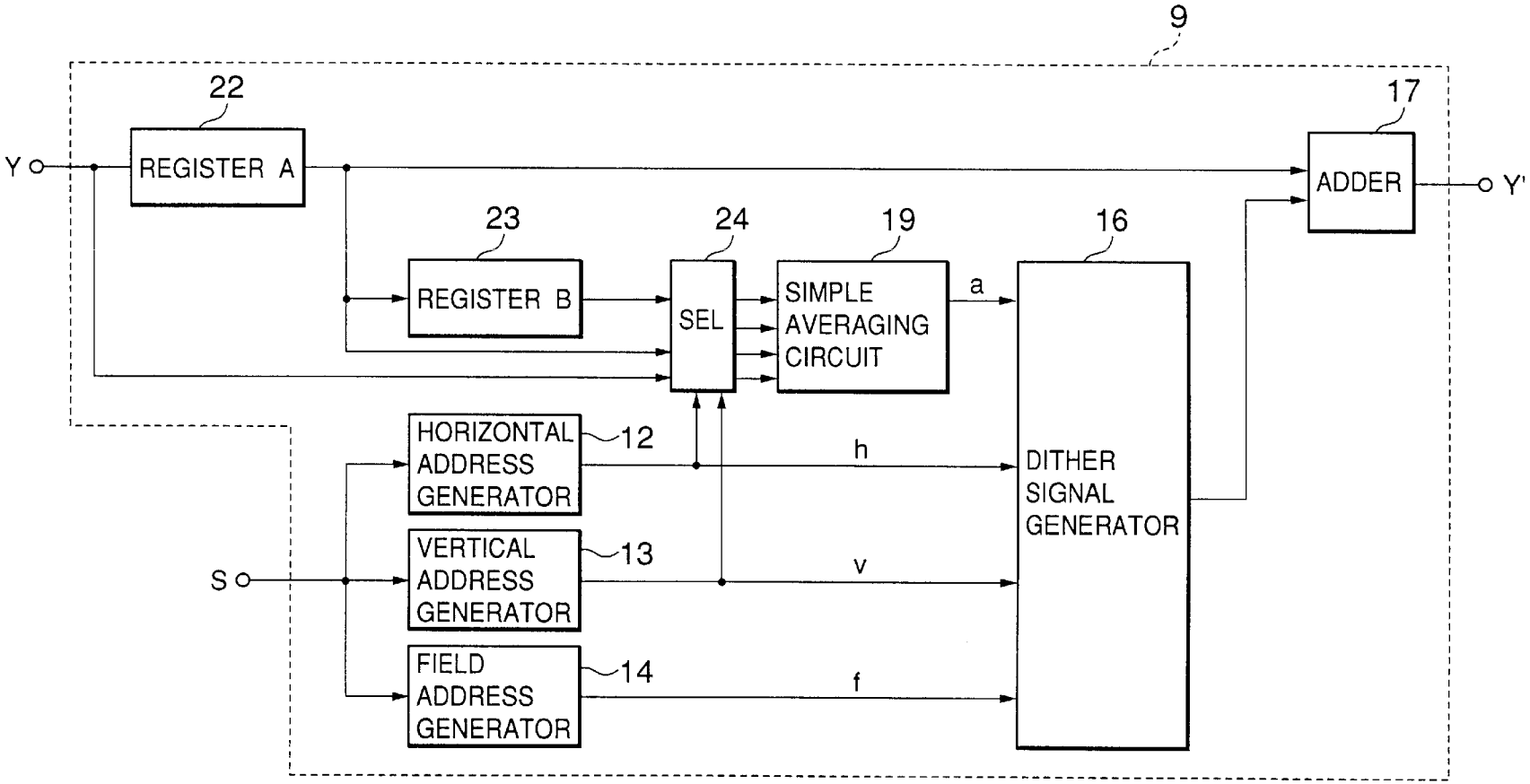
FIG. 19 is a block diagram of the luminance resolution enhancement circuit in a fourth embodiment of the invention.

Referring to FIG. 19, the fourth embodiment replaces the line memories A and B of the preceding embodiments with a pair of registers 22, 23 referred to below as registers A and B. Each register stores information concerning just one pixel. A selector 24 provides the simple averaging circuit 19 with the non-displayable components of two pixel values, which are selected according to the relative horizontal coordinate (h) output by the horizontal address generator 12.

Each ten-bit pixel value received from the inverse gamma corrector 4 is first stored in register A. The eight-bit displayable component of the stored value is supplied to the adder 17. The two-bit non-displayable component is supplied to register B and the selector 24. The selector 24 also receives the output of register B and the non-displayable component of the image signal Y from the inverse gamma corrector 4.

Registers A and B operate as one-pixel delay elements. When the adder 17 receives the displayable component of a pixel E, the selector 24 receives the non-displayable components of pixel E and the two pixels immediately adjacent to the left and right. If the relative horizontal coordinate of pixel E is zero, the selector 24 selects the non-displayable components of pixel E and the pixel to its right. If the relative horizontal coordinate of pixel E is one, the selector 24 selects the non-displayable components of pixel E and the pixel to its left.

The averaging circuit 19 calculates the simple average of the two values supplied by the selector 24. For example, if the relative horizontal coordinate of pixel E is one, the non-displayable component of pixel E is binary '10 '(two), and the non-displayable component of the pixel to the left of pixel E is binary '00' (zero), the simple averaging circuit 19 calculates that the average value of these two components as binary '01' (one).

The other elements shown in FIG. 19 operate as in the second embodiment.

The operation of the fourth embodiment will be described with reference to the pixel values in the two-by-two coordinate region shown in FIG. 20. The illustrated pixel values are ten-bit values in which only the two least significant bits have non-zero values.

Figure 20:
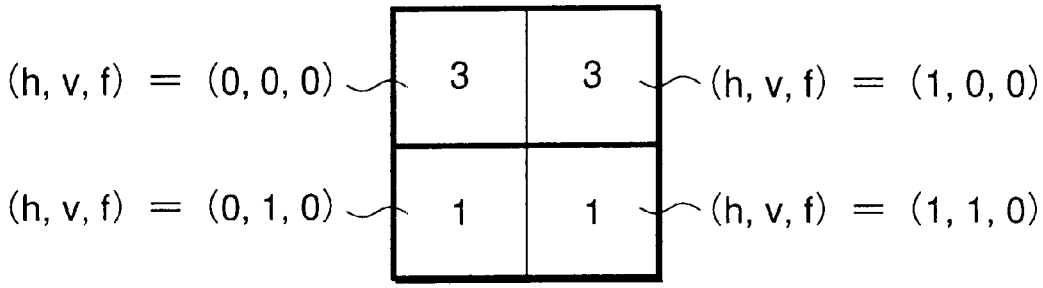
FIG. 20 shows another example of pixel values in a two-by-two region.

When the pixel in the upper left corner in FIG. 20 is processed, the selector 24 selects this pixel and the pixel to its right. The simple averaging circuit 19 calculates an average value of three. The dither signal generator 16 receives coordinate and average values (h, v, f, a) equal to (0, 0, 0, 3). From FIG. 8, the dither signal generator 16 generates a dither signal level equal to one.

When the pixel in the upper right corner is processed, the selector 24 selects this pixel and the pixel to its left. The simple averaging circuit 19 again calculates an average value of three. The dither signal generator 16 now receives (h, v, f, a) values equal to (1, 0, 0, 3), and generates a dither signal level again equal to one.

When the pixel in the lower left corner is processed, the selector 24 selects this pixel and the pixel to its right. The simple averaging circuit 19 now calculates an average value of one. The dither signal generator 16 receives (h, v, f, a) values equal to (0, 1, 0, 1), and generates a dither signal level equal to zero.

When the pixel in the lower right corner is processed, the selector 24 selects this pixel and the pixel to its left. The simple averaging circuit 19 again calculates an average value of one, and the (h, v, f, a) values of (1, 1, 0, 1) produce a dither signal level again equal to zero.

The output of the luminance resolution enhancement circuit 9 in this case is equal to the dither signal, having a normalized eight-bit value of $1/256$ for the two pixels in the top row in FIG. 20, and a value of $0/256$ for the two pixels in the bottom row. These values are close to the normalized ten-bit values of $3/1024$ in the top row and $1/1024$ in the bottom row.

In the second embodiment, the average value (two) of all four pixels would be applied throughout the two-by-two region. The dither signal would have a one and a zero in the top row, and a zero and a one in the bottom row.

In the fourth embodiment, the unit region and the averaging region are two-by-one regions, while the spatial coordinate region and dither region are two-by-two regions. The same dither pattern is applied to all pixels in each two-by-one unit region, but not necessarily to all pixels in each two-by-two dither region. By dividing each dither region into two unit regions, the fourth embodiment is able to provide improved vertical spatial resolution in cases such as FIG. 20.

When both of the two unit regions have the same rounded average value, the fourth embodiment operates in the same way as the second embodiment, faithfully simulating the non-displayable luminance level of the two unit regions combined. For example, the fourth embodiment gives the same result as the second embodiment in FIG. 16.

Next, a fifth embodiment will be described. The fifth embodiment simulates a twelve-bit luminance scale. The fifth embodiment has the same structure as the second embodiment, shown in FIGS. 3 and 14, but employs a twelve-bit analog-to-digital converter 3. The digital image signal Y output from the inverse gamma corrector 4 is a twelve-bit signal. The non-displayable component now comprises the four least significant bits. Line memory B stores four bits per pixel.

Figure 21:
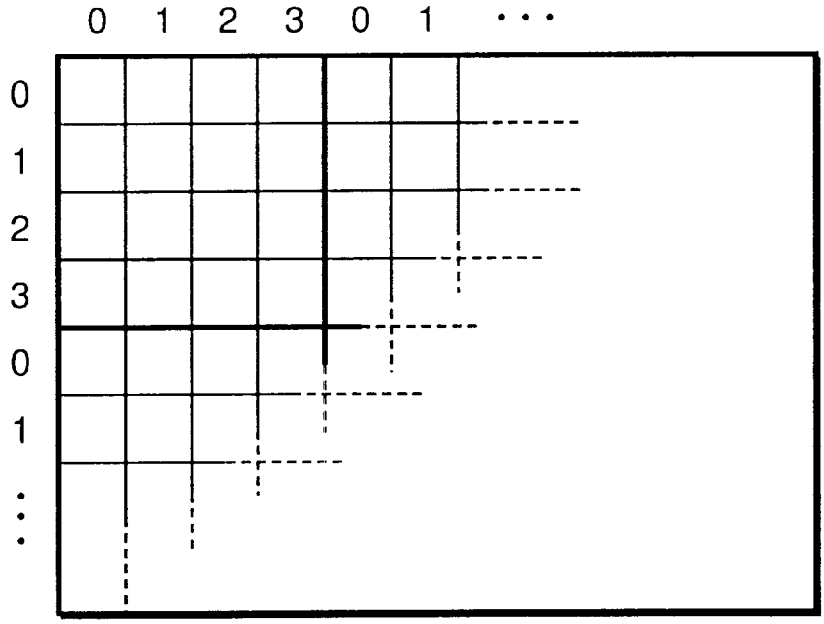
FIG. 21 illustrates relative spatial coordinates employed in a fifth embodiment of the invention.

The horizontal address generator 12, vertical address generator 13, and field address generator 14 in the fifth embodiment employ two-bit counters, generating relative spatial and temporal coordinates with values from zero to three. The relative spatial coordinate values are illustrated in FIG. 21. The spatial-temporal coordinate region size is four-by-four-by-four.

The selector 18 refers to the least significant bits of the relative spatial coordinates output by the horizontal and vertical address generators 12, 13 and operates as in the second embodiment, providing the averaging circuit 19 with the non-displayable components of four pixel values in a two-by-two region. The averaging circuit 19 obtains their simple average (a), which has a value in the range from zero to fifteen.

The dither signal generator 16 generates a dither signal level of zero or one according to the two-bit relative coordinate values (h, v, f) and average value (a). When the average value (a) is equal to zero, the dither signal level is zero. FIG. 22 illustrates the dither signal levels generated when the average value (a) is equal to one. Tables of the dither signal levels generated for average values (a) from two to fifteen will be omitted to avoid obscuring the invention with unnecessary detail.

In FIG. 22, the number of 1's in the dither signal in each four-by-four spatial region is not equal to the average value (a=1). There are two 1's in the regions with relative field coordinates (f) of zero and two, and no 1's in the regions with relative field coordinates of one and three. The average number of 1's in the dither patterns in two consecutive fields is, however, equal to the average value (a). Accordingly, the dither region is a four-by-four-by-two spatial-temporal region comprising four-by-four spatial regions in two consecutive fields. Alternatively, the dither region can be viewed as a two-by-two-by-four region comprising two-by-two spatial regions in four consecutive fields. In either case, the three-dimensional dither region size is smaller than the four-by-four-by-four coordinate region size, and larger than the two-by-two-by-one unit region size and averaging region size.

It is possible to make the number of 1's in the dither pattern equal to the average value (a) in every field, as illustrated in FIG. 23, for example, but this is not necessarily desirable. Particularly in a plasma display apparatus, in which very small pixels are difficult to fabricate, the dither pattern in FIG. 23 could produce a visible effect in which the eye fails to integrate the pixels generated by dithering, and sees a single gray pixel flitting about against a black background in a four-by-four region.

The dither pattern in FIG. 22 is more easily integrated by the human visual system, and does not produce perceived pixel motion. Some perceptible flicker may occur, particularly when a still image is displayed, as four-by-four regions with two 1's alternate with four-by-four regions with no 1's, but the flicker is confined to only two out of sixteen pixels. In terms of the normalized average luminance level in the four-by-four region, the magnitude of the flicker is only $2/4096$. This flicker is extremely faint, corresponding to one-eighth the minimum displayable luminance level. In its capability to reproduce the desired image without artifacts, the dither pattern in FIG. 22 is found to be superior to the dither pattern in FIG. 23.

The adder 17 operates as in the preceding embodiments, adding the dither signal to the eight-bit displayable component of the image signal. The sixteen (24) dither patterns simulate the four-bit non-displayable luminance levels, providing the simulated equivalent of twelve-bit luminance resolution.

In the fifth embodiment, as in the fourth embodiment, a single average value and a single dither pattern are applied within each unit region, but accurate simulation of the non-displayable image component takes place over the larger spatial-temporal size of the dither region.

The dither patterns shown in FIG. 8 can be used in the fifth embodiment when the average value (a) is four, eight, and twelve. In this case, for these particular average values, the dither signal generator 16 can ignore the most significant relative coordinate bits output by the address generators 12, 13, 14, and the dither region size is reduced to the unit region size (2×2×1).

Next, a sixth embodiment will be described. The sixth embodiment uses an external signal in selecting dither patterns.

Figure 24:
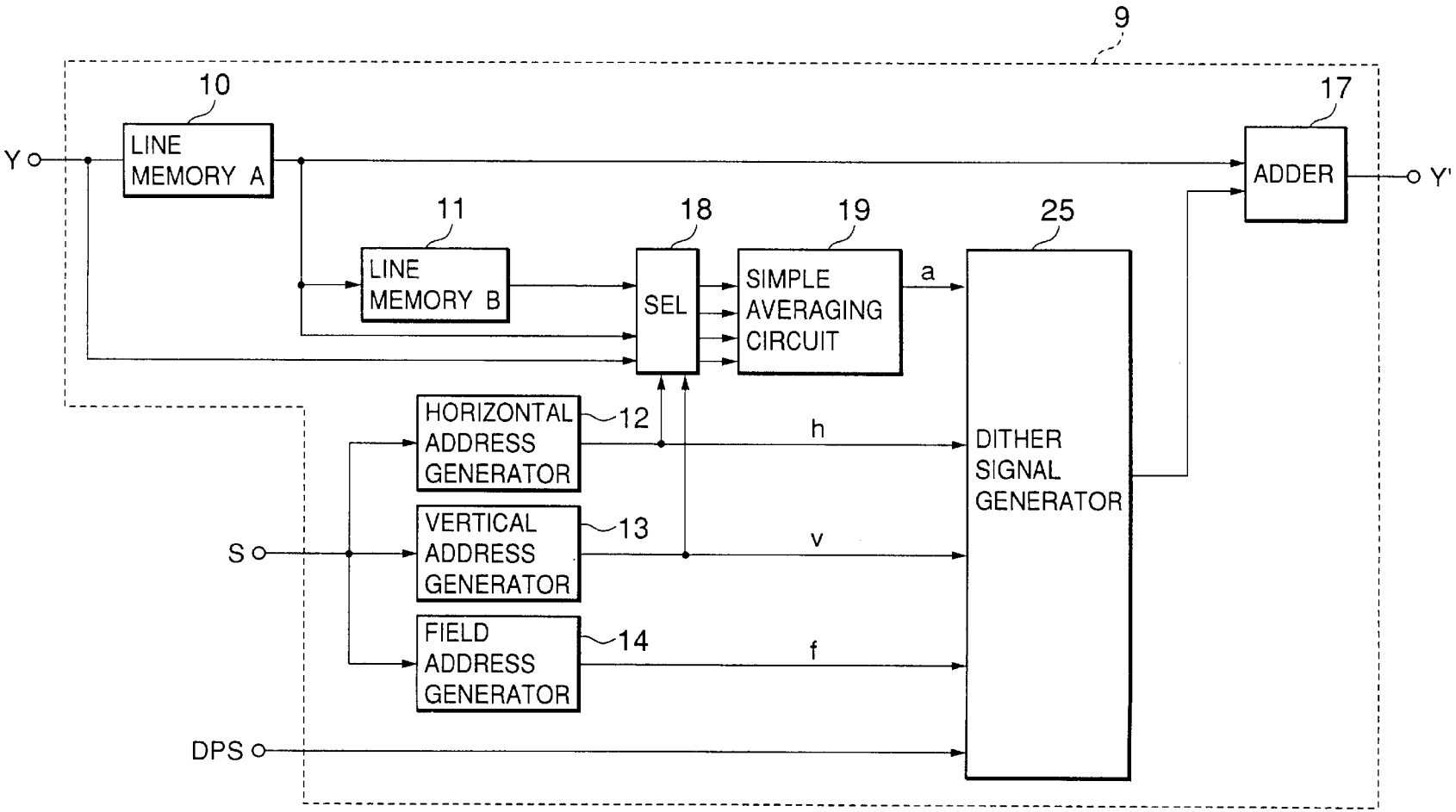
FIG. 24 is a block diagram of the luminance resolution enhancement circuit in a sixth embodiment of the invention.

The sixth embodiment has the same overall configuration as the second embodiment, shown in FIG. 3. FIG. 24 shows the internal structure of the luminance resolution enhancement circuit 9. The dither signal generator of the second embodiment is replaced by a dither signal generator 25 that receives a dither pattern selection signal DPS, as well as receiving the relative coordinates (h, v, f) output by the address generators 12, 13, 14 and the average value (a) calculated by the simple averaging circuit 19. The field address generator 14 comprises a two-bit counter and generates two-bit relative field coordinates. The other elements in FIG. 24 are identical to the corresponding elements in the second embodiment.

The dither pattern selection signal DPS is a one-bit signal having one value when a still image is displayed, and another value when a moving image is displayed. Still and moving images can be distinguished by detection of motion of objects in the image, for example, or by detecting the different synchronization signals provided by personal computers, which usually generate still images, and television broadcast stations, which usually broadcast moving images. When the average value (a) is equal to one, the dither signal generator 25 selects the dither pattern in FIG. 25 if the selection signal DPS indicates a still image, and the dither pattern in FIG. 26 if the selection signal DPS indicates a moving image.

Figure 25:
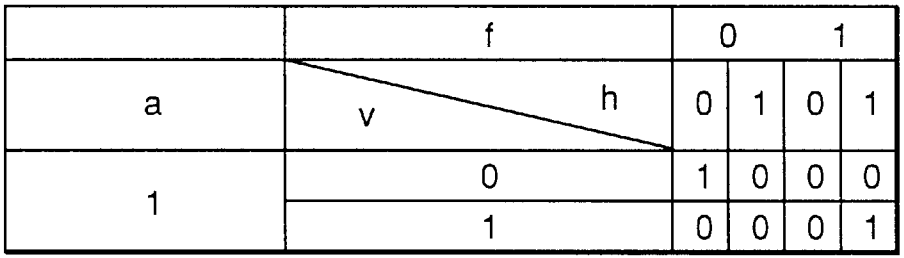
FIGS. 25 and 26 illustrates two dither patterns used in the sixth embodiment.

The dither pattern in FIG. 25 is identical to the corresponding pattern in FIG. 8 (a=1), and is suitable for simulating gradual luminance variations in still images, as described in the second embodiment. When this dither pattern is selected, the dither signal generator 25 uses only the least significant bit of the relative frame coordinate (f).

The effect of using the dither patterns in FIGS. 25 and 26 to reproduce a moving image comprising a vertical band traveling from left to right on a six-by-eight screen will be described next. FIG. 27 shows the first field, in which the vertical band occupies the left half of the screen. The vertical band has a ten-bit luminance level equal to one, while the rest of the image has a luminance level of zero. In each successive frame, the vertical band moves one pixel to the right, so that four frame later, the vertical band occupies the right half of the screen.

FIG. 28 shows how this vertical band would be displayed using the dither pattern in FIG. 25. Only the pixels in the vertical band are shown. The dither signal values of '1' are shown as ten-bit levels equal to four (4). In a field with a relative field coordinate (f) of zero, the dither signal appears at pixels with relative spatial coordinates (h, v) equal to (0, 0), which occur in the first and third columns of the band. In the next field, which has a relative field coordinate (f) of one, the dither signal appears at pixels with relative spatial coordinates equal to (1, 1). Since the vertical band has moved one column to the right, these pixels also occur in the first and third columns of the band. Subsequent fields are similar to these, the dither signal appearing only in the first and third columns of the band. Following the motion of the band, the human eye integrates the dither signal and sees two separate vertical stripes with average ten-bit luminance levels equal to two.

Figure 26:
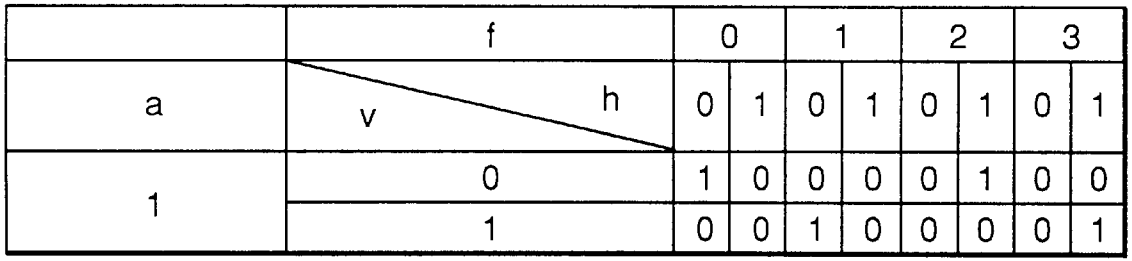

When the dither pattern in FIG. 26 is selected, the moving vertical band is displayed as shown in FIG. 29. Dither pixels appear with equal frequency in all rows and columns. Integrating the dither signal, the eye perceives a band with a uniform luminance level (1), as desired.

Thus the dither pattern in FIG. 26 is more suitable for displaying moving images. The dither pattern in FIG. 26 is less suitable for displaying still images, for the reason discussed in relation to FIG. 23 in the fifth embodiment.

A similar selection between two dither patterns is preferably made when the average value (a) is equal to three. When the average value (a) is equal to zero or two, the dither patterns in FIG. 8 can be used for both still and moving images.

By using different dither patterns for different types of images, the sixth embodiment avoids unwanted artifacts in both types of images.

Next, a seventh embodiment will be described. The seventh embodiment has the same overall configuration as the fifth embodiment, including a twelve-bit analog-to-digital converter 3. The seventh embodiment adjusts the simulated luminance resolution according to the luminance level of the image signal.

Figure 30:
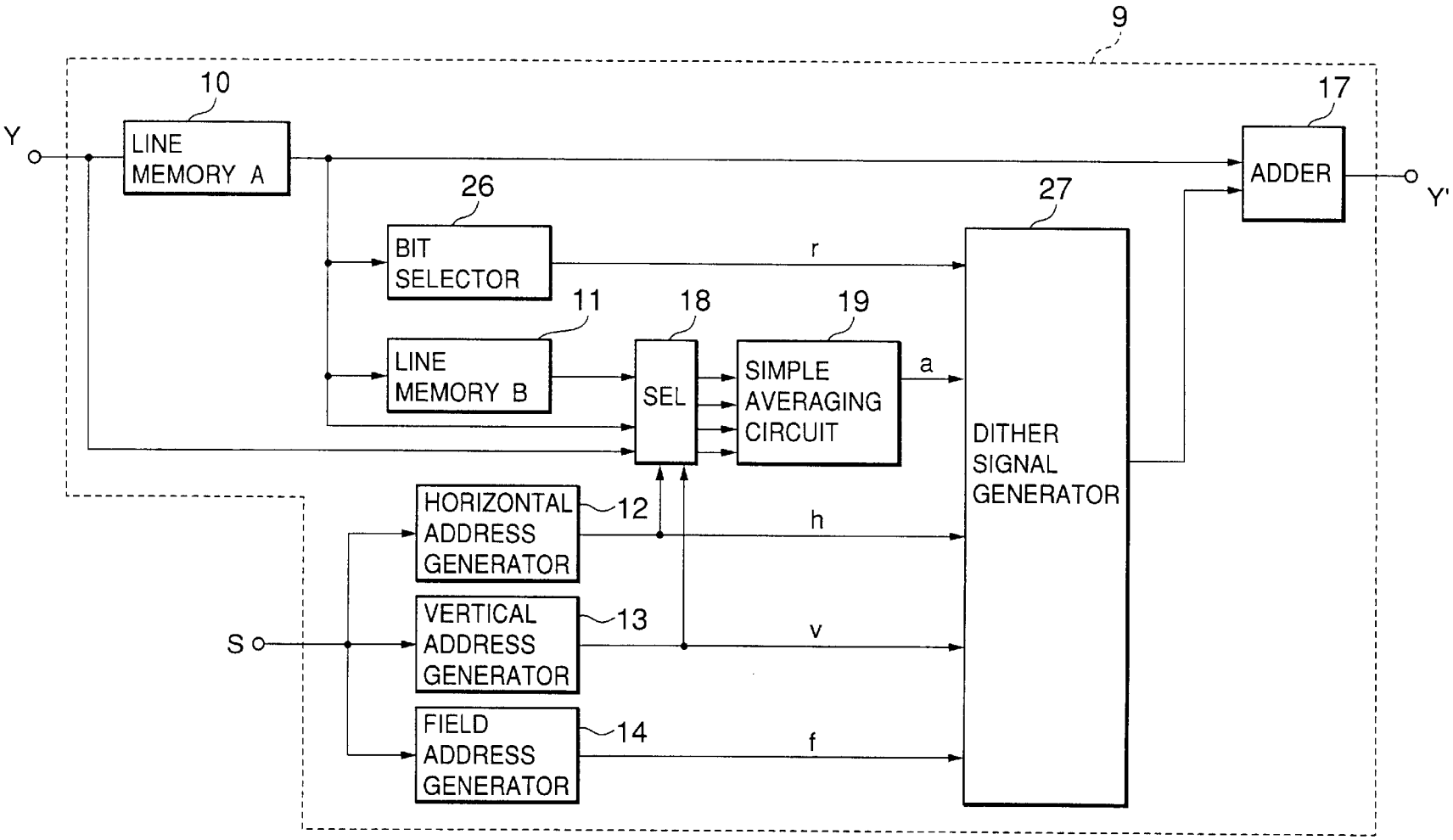
FIG. 30 is a block diagram of the luminance resolution enhancement circuit in a seventh embodiment of the invention.

Referring to FIG. 30, the luminance resolution enhancement circuit 9 in the seventh embodiment includes a bit selector 26 that receives the twelve-bit image signal Y output from line memory A. The bit selector 26 compares this signal with two thresholds and generates a two-bit resolution selection signal (r). The two thresholds are the lowest displayable non-black luminance level (16, since the image signal is a twelve-bit signal) and twice this level (32). The value of the resolution selection signal (r) is '00' when the image signal level is from zero to fifteen, '01' when the image signal level is from sixteen to thirty-one, and '10' when the image signal level is equal to or greater than thirty-two.

The dither signal generator 27 is similar to the dither signal generator in the fifth embodiment, having sixteen dither patterns, including, for example, the dither pattern shown in FIG. 22. These dither patterns will be referred to below as the zeroth dither pattern, the first dither pattern, and so on through the fifteenth dither pattern, the a-th dither pattern being the dither pattern applied in the fifth embodiment when the average value is 'a.' The dither signal generator 27 receives the resolution selection signal (r) output by the bit selector 26, the average value (a) calculated by the simple averaging circuit 19, and the relative coordinates (h, v, f) generated by the address generators 12, 13, 14.

When the resolution selection signal is '00' and the average value is 'a,' the dither signal generator 27 applies the a-th dither pattern, as in the fifth embodiment, thereby simulating four bits of luminance resolution.

When the resolution selection signal is '01,' the dither signal generator 27 selects only the three most significant bits of the average value (a) and uses only the even-numbered dither patterns. If the average value (a) is odd, the dither signal generator 27 uses the next lower-numbered dither pattern. For example, if the average value (a) is seven, the dither signal generator 27 uses the sixth dither pattern. Disregarding the least significant bit of the average value, the dither signal generator 27 simulates only three bits of luminance resolution.

When the resolution selection signal is '10,' the dither signal generator 27 selects the two most significant bits of the average value (a), disregards the two least significant bits, and uses only the zeroth, fourth, eighth, and twelfth dither patterns, simulating only two bits of luminance resolution. The dither signal generated in this case is, for example, the same as the dither signal in the second embodiment, employing the dither patterns in FIG. 8.

The other elements in FIG. 30 operate as in the fifth embodiment.

The seventh embodiment uses the dither signal to simulate twelve-bit luminance resolution when the displayable component of the image signal is black, eleven-bit resolution when the displayable component has the lowest non-black luminance level, and ten-bit resolution in other cases. The reason for this is that, while the human eye is increasingly sensitive to small luminance differences at low luminance levels, as more bits of luminance resolution are simulated, larger dither patterns are required and it becomes increasingly difficult to avoid artifacts such as flicker or stationary patterns. It is therefore advantageous to confine the use of large dither patterns such as the one in FIG. 22 to the lowest luminance levels, where the additional luminance resolution is most needed. At higher luminance levels, it is advantageous to select fewer bits of resolution, which can be simulated with smaller dither patterns.

The seventh embodiment is not limited to the selection of two, three, and four bits of the average value (a) according to the threshold values described above. There may be more or fewer than two threshold values. The threshold values can also be varied according to the overall luminance level of the image.

Next, an eighth embodiment will be described. The eighth embodiment restricts the averaging region of the second embodiment to pixels with luminance levels close to the level of the pixel being processed.

Figure 31:
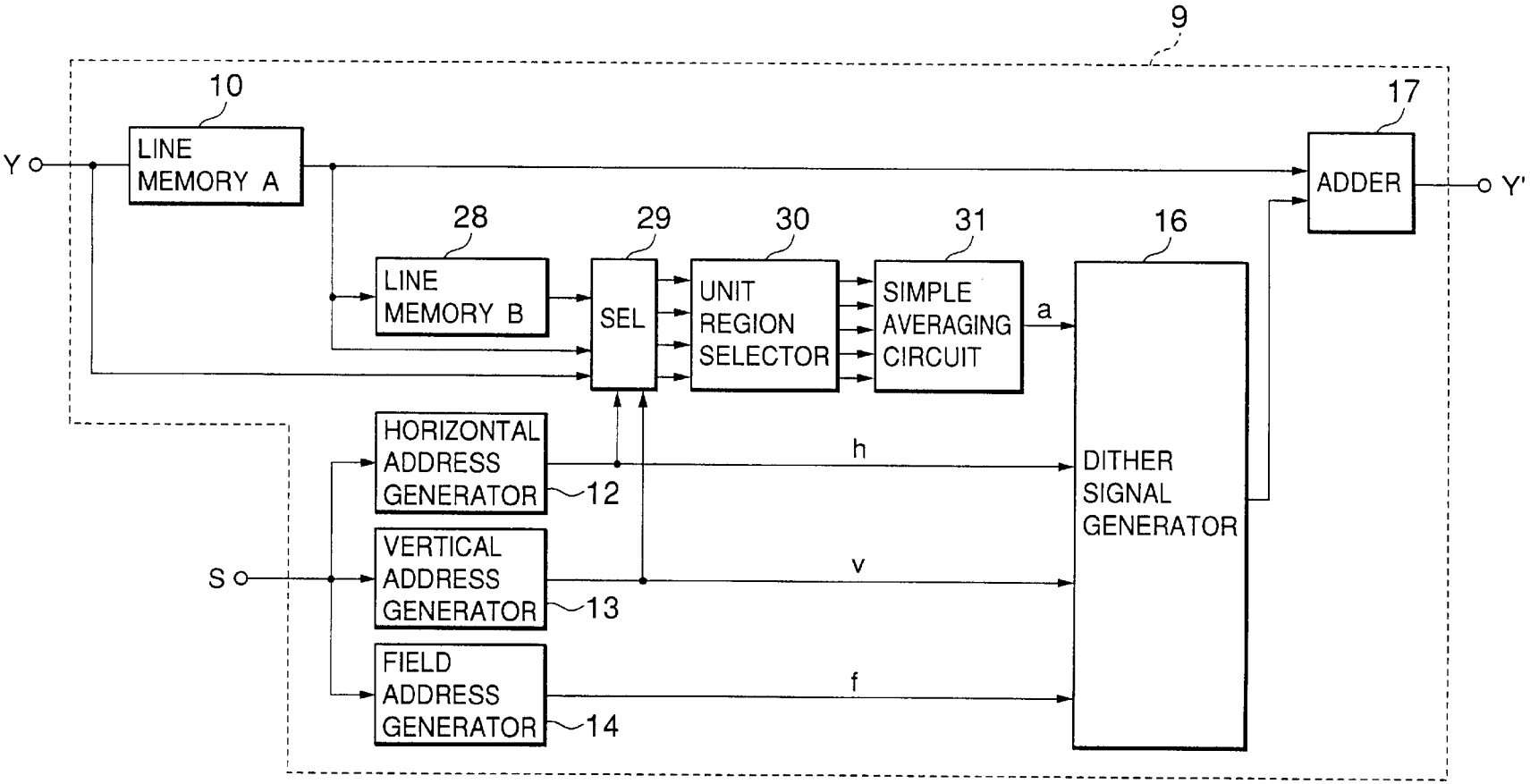
FIG. 31 is a block diagram of the luminance resolution enhancement circuit in an eighth embodiment of the invention.

The eighth embodiment has the overall structure shown in FIG. 3, employing a ten-bit analog-to-digital converter 3. Referring to FIG. 31, the luminance resolution enhancement circuit 9 in the eighth embodiment differs from the luminance resolution enhancement circuit in the second embodiment in the following regards.

Both line memories 10, 28 (line memories A and B) store all ten bits of the image signal. Selector 29 receives all ten bits from each line memory, and provides the ten-bit pixel values in the two-by-two regions shown in FIGS. 15A, 15B, 15C, and 15D to a unit region selector 30.

The unit region selector 30 outputs the values of the non-displayable components of these pixel values to the simple averaging circuit 31, but masks the components of pixels having luminance levels that differ by more than a predetermined threshold value from the luminance level of the pixel D being processed. The masked components, if any, are set equal to zero. The predetermined threshold value is equal to, for example, sixteen. The unit region selector 30 also provides the simple averaging circuit 31 with a pixel count indicating the number of components that have not been masked.

The simple averaging circuit 31 calculates the average value of the non-masked components by dividing the sum of the four component values received from the unit region selector 30 by the pixel count value.

The other elements in FIG. 31 operate as described in the second embodiment.

Figure 32:
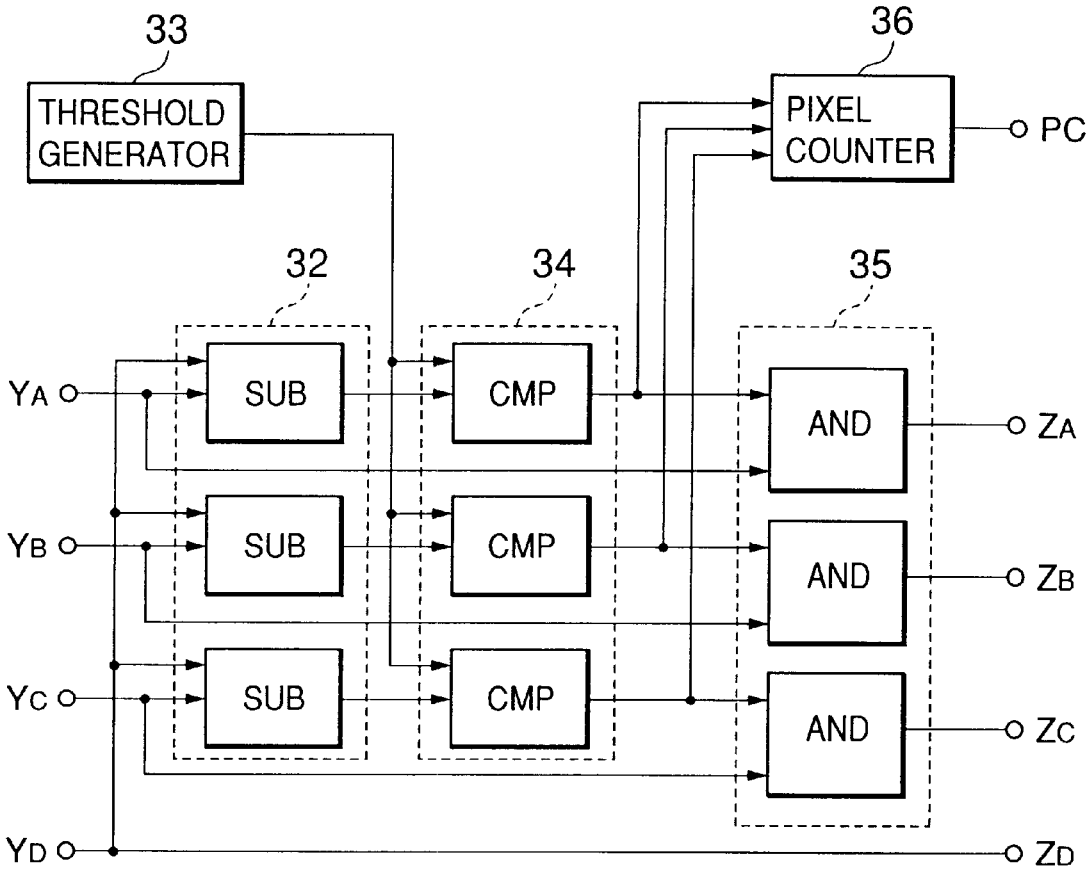
FIG. 32 is a more detailed block diagram of the unit region selector in FIG. 31.

FIG. 32 shows the internal structure of the unit region selector 30. The four pixel values received from selector 29 are denoted $Y_A$, $Y_B$, $Y_C$, $Y_D$, where $Y_D$ is the value of the pixel D being processed. Pixel values $Y_A$, $Y_B$, $Y_C$ are subtracted from $Y_D$ by subtractors (SUB) 32. The absolute values of the resulting differences are compared with a threshold value supplied from a threshold generator 33 by respective comparators (CMP) 34. The output of each comparator is a one-bit signal equal to zero if the absolute difference exceeds the threshold, and to one if the absolute difference does not exceed the threshold. Each one-bit comparison result is logically ANDed with both bits of the non-displayable component of the corresponding pixel value $Y_A$, $Y_B$, $Y_C$ by an AND circuit 35, generating output signals $Z_A$, $Z_B$, $Z_C$. The non-displayable component of $Y_D$ is output as a fourth signal $Z_D$. The three comparison results are also supplied to a pixel counter 36, which counts the number of '1' results and adds one, thereby generating a pixel count signal PC with a value of one, two, three, or four. The simple averaging circuit 31 divides the sum of $Z_A$, $Z_B$, $Z_C$ and $Z_D$ by PC.

The operation of the eighth embodiment will be illustrated with reference to the two-by-two region in FIG. 33, with ten-bit pixel values of zero, one, two, and thirty-two, assuming the above-mentioned threshold value of sixteen.

When the pixel in the top left corner of this region is processed, the unit region selector 30 masks the non-displayable component of the pixel in the bottom right corner, since the luminance level of that pixel (32) differs from the luminance level of the pixel being processed (0) by more than the threshold value (16). The simple averaging circuit 31 averages the three non-masked non-displayable components (0, 1, 2) and obtains an average value (a) equal to one.

When the pixels in the top right and bottom left corners are processed, the averaging circuit 31 performs the same calculation and obtains the same result (a=1).

When the pixel in the bottom right corner is processed, the other three pixels are all masked. The averaging circuit 31 divides the non-displayable component (0) of the pixel value in the bottom right corner by a pixel count of one, obtaining an average value (a) of zero.

In the eighth embodiment, when the four pixel values in a two-by-two spatial coordinate region differ by the threshold value or less, the non-displayable components of all four pixel values are averaged, and the average value (a) is accurately simulated by a dither pattern as in the second embodiment. When one or more of the four pixel values differs from the others by more than the threshold value, however, the size of the averaging region and unit region is reduced to exclude the differing pixel or pixels.

The eighth embodiment improves the sharpness of the output image. In an image having a bright vertical line one pixel wide on a black background, for example, the eighth embodiment calculates average values of zero for all of the background pixels, so that the background pixels remain completely black in the output image. In the second embodiment, depending on the non-displayable component of the bright line, some of the adjacent background pixels might be dithered to the luminance level just above black.

Next, a ninth embodiment will be described. The ninth embodiment employs the same luminance resolution enhancement circuit 9 as in the second embodiment, but uses an eight-bit analog-to-digital converter 3, and an inverse gamma corrector 4 that converts the eight-bit digital image signal X to a ten-bit signal Y. The eight-bit input value X and ten-bit output value Y are related so that if both are normalized by division by the maximum displayable luminance level, Y is equal to X raised to the power of 2.2, this being a standard inverse gamma function.

Figures 33, 34:
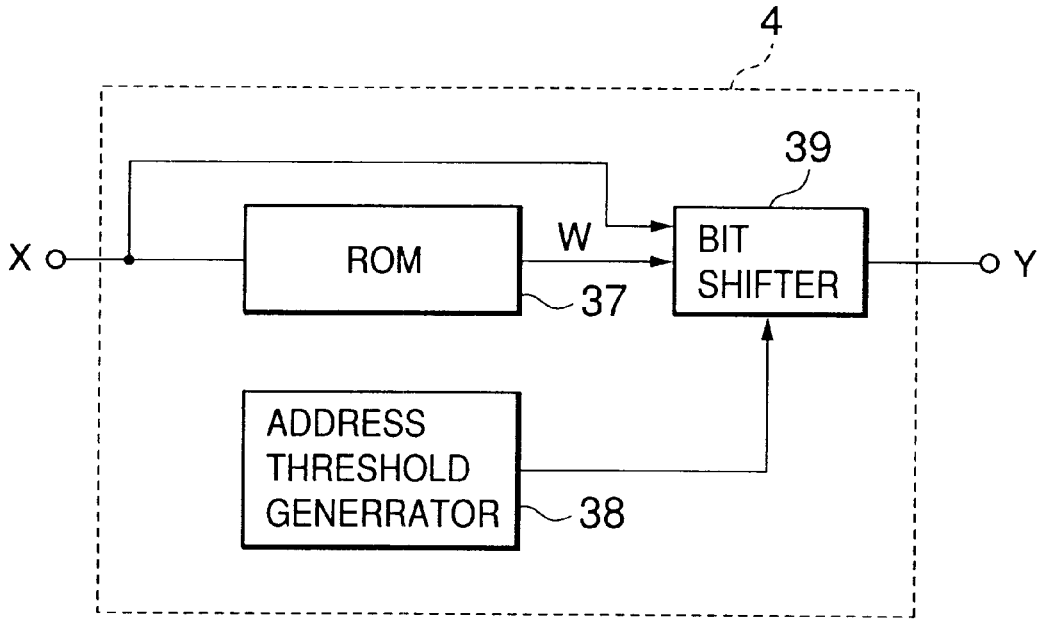
FIG. 33 shows another example of pixel values in a two-by-two region.
FIG. 34 is a block diagram of the inverse gamma corrector in a ninth embodiment of the invention.

Referring to FIG. 34, the inverse gamma corrector 4 in the ninth embodiment comprises a read-only memory (ROM) 37, an address threshold generator 38, and a bit shifter 39.

The ROM 37 receives the eight-bit digital image signal X from the analog-to-digital converter 3 as an address signal, and outputs an eight-bit value stored at the corresponding address. If the address value X is equal to or greater than one hundred twenty-eight (128), the stored value (W) is related to the input address value X as follows.

$$W=(x/255)^{2.2} \times 255$$

The stored value W is necessarily rounded off to the nearest integer. For example, if the input address value X is one hundred forty-three (143), W is approximately 71.4, and the stored eight-bit value is seventy-one (71), or '01000111' in binary notation.

If the input address value is less than one hundred twenty-eight, the stored value is calculated in the same way, but is shifted two bits to the left, so that in effect a ten-bit value is stored without its two leading 0's. For example, if the input address value X is one hundred nine (109), the above calculation gives approximately 39.3, or '00100111.01. . . ' in binary notation, and the stored eight-bit value W is '10011101.'

The address threshold generator 38 generates an address threshold value of one hundred twenty-eight (128).

The bit shifter 39 receives the input address value (X), the eight-bit output (W) from the ROM 37, and the address threshold value (128), and generates the ten-bit output value (Y) If the input address value is equal to or greater than the address threshold value, the stored value W is output as the eight most significant bits of the output value Y, the two least significant bits being zero, making the non-displayable component of Y equal to zero. For example, if the input address X is one hundred forty-three (143), then W is '01000111' and the output value Y is '0100011100.' If the input address value X is less than the address threshold value, the bit shifter 39 obtains Y by shifting W two bits to the right, adding two zero bits on the left. For example, if the input address X is one hundred nine (109), then W is '10011101' and the output value Y is '0010011101.'

The luminance resolution enhancement circuit 9 operates as in the second embodiment. When the analog-to-digital converter 3 obtains a luminance value X less than the threshold value of one hundred twenty-eight, the luminance resolution enhancement circuit 9 uses dithering to simulate ten-bit luminance resolution. When the analog-to-digital converter 3 obtains a luminance value X of one hundred twenty-eight or more, however, no dithering is performed, because the non-displayable component of the ten-bit value (Y) is zero. The ninth embodiment accordingly provides simulated ten-bit luminance resolution at low luminance levels, where the eye is more sensitive to subtle luminance variations, and eight-bit resolution at higher luminance levels, where the eye is less sensitive to subtle variations.

The ninth embodiment provides a perceived output image quality approaching that of the second embodiment, while requiring only an eight-bit analog-to-digital converter 3.

In a variation of the ninth embodiment, the address threshold generator 38 generates multiple address thresholds. For example, the address threshold generator 38 may generate three address thresholds $T_1$, $T_2$, $T_3$. The value stored in the ROM 37 is shifted three, two, one, or zero bits to the left according to whether the address value is less than $T_1$, between $T_1$ and $T_2$, between $T_2$ and $T_3$, or greater than $T_3$. The bit shifter 39 adds different numbers of zeros on the right or left according to these address thresholds, thereby generating an eleven-bit image signal. The luminance resolution enhancement circuit 9 employs dither patterns capable of simulating up to three additional bits of luminance resolution. In this variation, the simulated luminance resolution varies from eight bits to eleven bits, depending on the luminance level.

In another variation of the ninth embodiment, the inverse gamma corrector 4 provides eight-bit output, but the simple averaging circuit 19 in the luminance resolution enhancement circuit 9 calculates an average value (a) with different numbers of significant bits, depending on the luminance level, so that the simulated luminance resolution increases as the luminance level decreases.

In all of the preceding embodiments, the luminance resolution enhancement circuit 9 extends the luminance resolution of the display apparatus by generating a dither signal that simulates a non-displayable component of the image signal, and adding the dither signal to the displayable component of the image signal. The dither signal is generated from relative spatial and temporal coordinates (h, v, f) and an average value (a). The average value (a) is the non-displayable component of the average luminance level of the pixels in a certain averaging region. The dither signal is thus responsive to the input image signal, rather than having a predetermined pattern or a random pattern.

In the second and third embodiments, the averaging region coincides with a unit region within which the calculated average value is applied, and to a dither region within which the dither signal accurately simulates the calculated average value by providing a proportional number of 1's. The image is accordingly reproduced faithfully.

In the fourth embodiment, the averaging region and unit region are identical, but they are reduced to a size smaller than the dither region, improving the spatial resolution of the image.

In the fifth embodiment, the dither region is enlarged in the temporal dimension, or in both the spatial and temporal dimensions, to provide additional bits of simulated luminance resolution.

In the eighth embodiment, the averaging region and unit region are restricted to pixels having approximately similar luminance levels, thereby avoiding loss of sharpness.

In the sixth embodiment, the dither signal is also made responsive to a dither pattern selection signal, enabling suitable dither patterns to be used for both still and moving images.

In the seventh and ninth embodiments, the number of bits of simulated luminance resolution is varied according to the luminance level, so that maximum luminance resolution is provided at low luminance levels, where it is most needed, and artifacts such as flicker are avoided at higher luminance levels. In the seventh embodiment, this is done by using a variable number of most significant bits of the average value (a). In the ninth embodiment, the image signal itself is converted so as to provide increased luminance resolution at lower luminance levels.

For simplicity, the invention has been described without reference to color, but the invention can also be practiced in color display apparatus. In apparatus in which each image pixel comprises red, green, and blue sub-pixels or cells, for example, a luminance resolution enhancement circuit 9 can be provided for each color component. In this case, the various regions described in the preceding embodiments comprise sub-pixels or cells of the same color.

The invention has been described in relation to plasma display apparatus, but can also be practiced in DMD display apparatus, electroluminescent (EL) display apparatus, liquid crystal display apparatus, and other apparatus displaying digital image signals with multiple luminance levels.

Those skilled in the art will recognize that further variations are possible within the scope claimed below.

What is claimed is:

1. A luminance resolution enhancement circuit converting a digital image signal with (m+n)-bit input pixel values to an output image signal with m-bit output pixel values, where m and n are positive integers, each input pixel value having an m-bit displayable component and an n-bit non-displayable component, comprising:

an address generating means generating spatial and temporal coordinates that identify a relative position of each said input pixel value within a spatial and temporal coordinate region;

an averaging means calculating, for each said input pixel value, an average value representing an average non-displayable component of the input pixel values in an averaging region including said input pixel value;

a dithering means coupled to said address generating means and said averaging means, generating a dither signal according to said spatial and temporal coordinates and said average value; and an arithmetic means coupled to said dithering means, additively combining said dither signal with the displayable component of each said input pixel value, thereby generating said output image signal.

2. The luminance resolution enhancement circuit of claim 1, wherein said averaging means calculates identical average values for all of the input pixel values in said averaging region.

3. The luminance resolution enhancement circuit of claim 2, wherein each said spatial and temporal coordinate region comprises at least one dither region in which, when said averaging means calculates identical average values throughout said dither region, said dither signal has an average level substantially proportional to said identical average values.

4. The luminance resolution enhancement circuit of claim 3, wherein said dither region is identical to said averaging region.

5. The luminance resolution enhancement circuit of claim 3, wherein said dither region is larger than said averaging region.

6. The luminance resolution enhancement circuit of claim 5, wherein said dither region extends over multiple temporal coordinate values.

7. The luminance resolution enhancement circuit of claim 1, also receiving a selection signal, wherein said dithering means generates said dither signal according to said selection signal as well as to said spatial and temporal coordinates and said average value.

8. The luminance resolution enhancement circuit of claim 7, wherein said selection signal distinguishes between still images and moving images.

9. The luminance resolution enhancement circuit of claim 1, further comprising a selector comparing each said input pixel value with at least one predetermined threshold value, thereby generating a resolution selection signal, and supplying said resolution selection signal to said dithering means, wherein:

said dithering means uses said resolution selection signal to select a number of most significant bits of the average value received from said averaging means, and uses only the selected bits of said average value in generating said dither signal.

10. The luminance resolution enhancement circuit of claim 9, wherein said number of most significant bits increases with decreasing luminance level of said input pixel value.

11. The luminance resolution enhancement circuit of claim 1, wherein said averaging region is restricted to input pixel values mutually differing by at most a predetermined threshold value.

12. An image display apparatus comprising:

the luminance resolution enhancement circuit of claim 1;

an analog-to-digital converter coupled to said luminance resolution enhancement circuit, receiving an analog image signal and converting said analog image signal to said digital image signal with (m+n)-bit input pixel values; and display means coupled to said luminance resolution enhancement circuit, displaying said output image signal.

13. An image display apparatus comprising:

the luminance resolution enhancement circuit of claim 1;

an analog-to-digital converter receiving an analog image signal and converting said analog image signal to a digital image signal with pixel values having fewer than m+n bits;

an inverse gamma corrector coupled to said analog-to-digital converter and said luminance resolution enhancement circuit, converting the digital image signal generated by said analog-to-digital converter to said digital image signal with (m+n)-bit input pixel values, providing more luminance resolution at low luminance levels than at high luminance levels; and display means coupled to said luminance resolution enhancement circuit, displaying said output image signal.

14. A method of converting a digital image signal with (m+n)-bit input pixel values to an output image signal with m-bit pixel values, where m and n are positive integers, each input pixel value having an m-bit displayable component and an n-bit non-displayable component, comprising the steps of:

generating spatial and temporal coordinates that identify a relative position of each said input pixel value within a spatial and temporal coordinate region;

calculating, for each said input pixel value, an average value representing an average non-displayable component of the input pixel values in an averaging region including said input pixel value;

generating a dither signal according to said spatial and temporal coordinates and said average value; and additively combining said dither signal with the displayable component of each said input pixel value, thereby generating said output image signal.

15. The method of claim 14, wherein:

said step of calculating calculates identical average values for all of the input pixel values in said averaging region; and each said spatial and temporal coordinate region comprises at least one dither region in which, when said step of calculating calculates identical average values for all of the input pixel values in said dither region, said dither signal has an average level substantially proportional to said identical average values, said dither region including at least one said averaging region.

16. The method of claim 14, further comprising the step of receiving a selection signal distinguishing between still and moving images, wherein said step of generating generates different dither signals according to said selection signal.

17. The method of claim 14, further comprising the steps of:

comparing each said input pixel value with at least one predetermined threshold value, thereby generating a resolution selection signal; and selecting different numbers of most significant bits of said average value for use in generating said dither signal, responsive to said resolution selection signal.

18. The method of claim 14, further comprising the step of restricting said averaging region to input pixel values mutually differing by at most a predetermined threshold value.

19. A luminance resolution enhancing apparatus converting a digital image signal with (m+n)-bit input pixel values to an output image signal with m-bit output pixel values, where m and n are positive integers, each input pixel value having an m-bit displayable component and an n-bit non-displayable component, said apparatus comprising:

an input receiving said input pixel values;

an address generator operatively connected to said input, said address generator generating spatial and temporal coordinates that identify a relative position of each said input pixel value within a spatial and temporal coordinate region;

an averager operatively connected to said input, said averager calculating, for each said input pixel value, an average value representing an average non-displayable component of the input pixel values in an averaging region including said input pixel value;

a dither generator operatively connected to said address generator and said averager, said dither generating a dither signal according to said spatial and temporal coordinates and said average value; and a processor operatively connected to said dither generator, said processor combining said dither signal with the displayable component of each said input pixel value, thereby generating said output image signal.

20. The luminance resolution enhancing apparatus according to claim 19, wherein said averager calculates identical average values for all of the input pixel values in said averaging region.

21. The luminance resolution enhancing apparatus according to claim 20, wherein each said spatial and temporal coordinate region comprises at least one dither region in which, when said averager calculates identical average values throughout said dither region, said dither signal has an average level substantially proportional to said identical average values.

22. The luminance resolution enhancing apparatus according to claim 21, wherein said dither region is identical to said averaging region.

23. The luminance resolution enhancing apparatus according to claim 21, wherein said dither region is larger than said averaging region.

24. The luminance resolution enhancing apparatus according to claim 23, wherein said dither region extends over multiple temporal coordinate values.

25. The luminance resolution enhancing apparatus according to claim 19, also receiving a selection signal, wherein said dither generator generates said dither signal according to said selection signal as well as to said spatial and temporal coordinates and said average value.

26. The luminance resolution enhancing apparatus according to claim 25, wherein said selection signal distinguishes between still images and moving images.

27. The luminance resolution enhancing apparatus according to claim 19, further comprising a selector operatively connected to said input, said selector comparing each said input pixel value with at least one predetermined threshold value and thereby generating a resolution selection signal, said selector supplying said resolution selection signal to said dither generator, wherein said dither generator uses said resolution selection signal to select a number of most significant bits of said average value received from said averager, and wherein said dither generator uses only the selected bits of said average value in generating said dither signal.

28. The luminance resolution enhancing apparatus according to claim 27, wherein said number of most significant bits increases with decreasing luminance level of said input pixel value.

29. The luminance resolution enhancing apparatus according to claim 19, wherein said averaging region is restricted to input pixel values mutually differing by at most a predetermined threshold value.

30. The luminance resolution enhancing apparatus according to claim 19, said apparatus further comprising:

an analog-to-digital converter operatively connected to said input , said analog to digital converter receiving an analog image signal and converting said analog image signal to said digital image signal with (m+n)-bit input pixel values; and a display element operatively connected to said processor, said display element displaying said output image signal.

31. The luminance resolution enhancing apparatus according to claim 19, said apparatus further comprising:

an analog-to-digital converter receiving an analog image signal and converting said analog image signal to a digital image signal with pixel values having fewer than m+n bits;

an inverse gamma corrector operatively connected to said analog-to-digital converter and to said input, said inverse gamma corrector converting the digital image signal generated by said analog-to-digital converter to said digital image signal with (m+n) -bit input pixel values; and a display element operatively connected to said processor, said display element displaying said output image signal, wherein said apparatus provides more luminance resolution at low luminance levels than at high luminance levels.

* * * * *